US008598799B2

(12) United States Patent
Tai et al.

(10) Patent No.: US 8,598,799 B2
(45) Date of Patent: Dec. 3, 2013

(54) ALTERNATING CURRENT LIGHT EMITTING DEVICE

(75) Inventors: Sheng-Chieh Tai, Taichung County (TW); Wen-Yung Yeh, Hsinchu County (TW); Yi-Jen Chan, Taoyuan County (TW)

(73) Assignee: Epistar Corporation, Hsinchu (TW)

( * ) Notice: Subject to any disclaimer, the term of this patent is extended or adjusted under 35 U.S.C. 154(b) by 453 days.

(21) Appl. No.: 12/337,755

(22) Filed: Dec. 18, 2008

(65) Prior Publication Data

US 2009/0160370 A1 Jun. 25, 2009

(30) Foreign Application Priority Data

Dec. 19, 2007 (CN) ..... 2007 1 0300180
Nov. 20, 2008 (TW) ..... 97144995 A

(51) Int. Cl.
*H05B 41/16* (2006.01)

(52) U.S. Cl.
USPC ..... 315/246; 315/294; 315/312

(58) Field of Classification Search
USPC ..... 315/185 R, 185 S, 187, 192, 210, 246, 315/291, 294, 312
See application file for complete search history.

(56) References Cited

U.S. PATENT DOCUMENTS

| | | | | |
|---|---|---|---|---|
| 5,977,722 | A * | 11/1999 | Yokokawa et al. | 315/207 |
| 7,148,515 | B1 * | 12/2006 | Huang et al. | 257/84 |
| 7,391,168 | B1 * | 6/2008 | Dernovsek et al. | 315/291 |
| 7,401,962 | B2 * | 7/2008 | Yamashita et al. | 362/606 |
| 7,649,322 | B2 * | 1/2010 | Neuman et al. | 315/185 S |
| 2004/0080941 | A1 * | 4/2004 | Jiang et al. | 362/252 |
| 2005/0002191 | A1 * | 1/2005 | Shimizu et al. | 362/237 |
| 2006/0202915 | A1 * | 9/2006 | Chikugawa | 345/46 |
| 2007/0008721 | A1 * | 1/2007 | Peng et al. | 362/227 |
| 2007/0102717 | A1 * | 5/2007 | Lee et al. | 257/98 |
| 2007/0273299 | A1 * | 11/2007 | Miskin et al. | 315/250 |
| 2007/0276455 | A1 * | 11/2007 | Fiset | 607/91 |
| 2008/0094000 | A1 | 4/2008 | Yamamoto et al. | |
| 2008/0122376 | A1 * | 5/2008 | Lys | 315/192 |
| 2008/0211421 | A1 * | 9/2008 | Lee et al. | 315/250 |
| 2008/0258643 | A1 * | 10/2008 | Cheng et al. | 315/246 |
| 2010/0231133 | A1 * | 9/2010 | Lys | 315/185 R |
| 2011/0227487 | A1 * | 9/2011 | Nichol et al. | 315/158 |

FOREIGN PATENT DOCUMENTS

| | | |
|---|---|---|
| WO | 2007001116 | 1/2007 |
| WO | 2008038918 | 4/2008 |

* cited by examiner

*Primary Examiner* — Tung X Le
(74) *Attorney, Agent, or Firm* — Bacon & Thomas, PLLC

(57) ABSTRACT

An alternating current (AC) light emitting device includes an AC light emitting diode (LED) module and a waveform modulation unit. The AC LED module includes at least two sets of micro-diodes. The waveform modulation unit coupled between the AC LED module and an AC voltage source modulates a waveform of the AC voltage source.

8 Claims, 21 Drawing Sheets

ALTERNATING CURRENT LIGHT EMITTING DEVICE

This application claims the benefits of People's Republic of China Serial No. 200710300180.5, filed Dec. 19, 2007 and Taiwan application Serial No. 97144995, filed Nov. 20, 2008, the subject matter of which is incorporated herein by reference.

BACKGROUND OF THE INVENTION

1. Field of the Invention

The invention relates in general to an alternating current light emitting device, and more particularly to an alternating current light emitting device capable of directly using an AC voltage source of mains and having high light emitting efficiency.

2. Description of the Related Art

A light emitting diode (LED) has the high endurance, the long lifetime, the light and handy property and the low power consumption and does not contain harmful substances, such as mercury, and thus becomes an extremely ideal light emitting device for the new generation of illumination. Recently, the invention of the blue LED solves the problem of electrostatic discharge (ESD) protection. In addition, the enhancement of the luminance of the LED enables the application field of the LED to grow continuously, and the LED has become the indispensable and important illumination tool in the modern life. For example, LEDs may be used as indicators, displays, the indoor/outdoor illumination and the vehicle illumination, and the cost of the LED has been greatly reduced.

FIG. 1A (Prior Art) shows waveforms of an input voltage and a current in a conventional diode light emitting device. A threshold voltage of each micro-diode only ranges from 2 to 5V, so multiple micro-diodes have to be connected to form a string so that the string can be used and powered by the mains provided by the electric power company. Thus, the equivalent threshold voltage of the string of micro-diodes may reach about 90V or higher. In other words, the current cannot flow through the micro-diodes until the input voltage provided by the AC voltage source is higher than 90V (about t=0.002 to 0.006 seconds) in the positive half cycle of the AC voltage source. Similarly, the current cannot flow through the micro-diodes until the input voltage provided by the AC voltage source is lower than −90V (about t=0.010 to 0.014 seconds) in the negative half cycle of the AC voltage source.

FIG. 1B (Prior Art) shows waveforms of the current and a light output of an AC LED module in the conventional diode light emitting device. As shown in FIG. 1B, when no current flows through the micro-diodes, no light is outputted. In other words, the micro-diodes cannot output the light until the input voltage provided by the AC voltage source is higher than the positive and negative threshold voltage (i.e., t=0.002 to 0.006 seconds, and about t=0.010 to 0.014 seconds).

In general, the power may be divided into the apparent power and the real power in calculation. The apparent power is the product of the voltage and the least mean square of the current in one cycle, while the real power is the average of the products of the voltages and the currents at many points in one cycle. Furthermore, the power factor is the ratio of the real power to the apparent power. Usually, the too-small power factor causes the loading of the electric apparatus and the electric power wastage. For example, Taiwan electric power company requests the power factor to be greater than 0.8.

As shown in FIGS. 1A and 1B, it is obtained that the power factor of the micro-diodes powered by the AC voltage source must be smaller than 1. Furthermore, when the overall threshold voltage is too high, the proportion of the micro-diodes, which do not emit light, is increased so that the flicker extent is increased. In addition, the frequency of the input voltage provided by the AC voltage source also influences the flicker extent of the micro-diode. When the frequency of the input voltage is too low, the flicker extent of the micro-diode is increased.

SUMMARY OF THE INVENTION

The invention is directed to an alternating current light emitting device capable of directly using an AC voltage source of mains, and modulating the waveform or the frequency of the AC voltage source, sequentially turning on LEDs with different micro diode areas according to the voltage of the AC voltage source, or changing serial or parallel connection states of the LEDs such that currents flowing through the LEDs become uniform. Thus, the alternating current light emitting device has the high light emitting efficiency, and can improve the problem of flicker of lighting.

According to a first aspect of the present invention, an alternating current (AC) light emitting device including an AC LED module and a waveform modulation unit is provided. The AC LED module includes at least two sets of micro-diodes. The waveform modulation unit coupled between the AC LED module and an AC voltage source modulates a waveform of the AC voltage source.

According to a second aspect of the present invention, an alternating current (AC) light emitting device including an AC LED module and a frequency modulation unit is provided. The AC LED module includes at least two sets of micro-diodes. The frequency modulation unit coupled between the AC LED module and an AC voltage source adjusts a frequency of the AC voltage source.

According to a third aspect of the present invention, an alternating current (AC) light emitting device including a plurality of LEDs and a control unit is provided. At least some of the LEDs have different micro diode areas. The control unit controls the LEDs. When the LEDs are driven by an AC voltage source, the control unit sequentially turns on the LEDs having different micro diode areas according to a voltage of the AC voltage source.

According to a fourth aspect of the present invention, an alternating current (AC) light emitting device including a control unit and a plurality of LEDs is provided. Each of the LEDs has an anode and a cathode, which are electrically connected to the control unit. When the LEDs are driven by an AC voltage source, the control unit changes serial or parallel connection states of the LEDs according to a voltage of the AC voltage source so that currents flowing through the LEDs become uniform.

The invention will become apparent from the following detailed description of the preferred but non-limiting embodiments. The following description is made with reference to the accompanying drawings.

DETAILED DESCRIPTION OF THE INVENTION

The invention provides an alternating current (AC) light emitting device capable of directly using an AC voltage source of mains and modulating the waveform or the frequency of the AC voltage source, turning on light emitting diodes (LEDs) with different micro diode areas according to a voltage of the AC voltage source, or changing serial or parallel connection states of the LEDs so that currents flowing through the LEDs become uniform. So, the alternating current light emitting device has the high light emitting efficiency, and can improve the problem of flicker of lighting.

First Embodiment

Figure 1A:
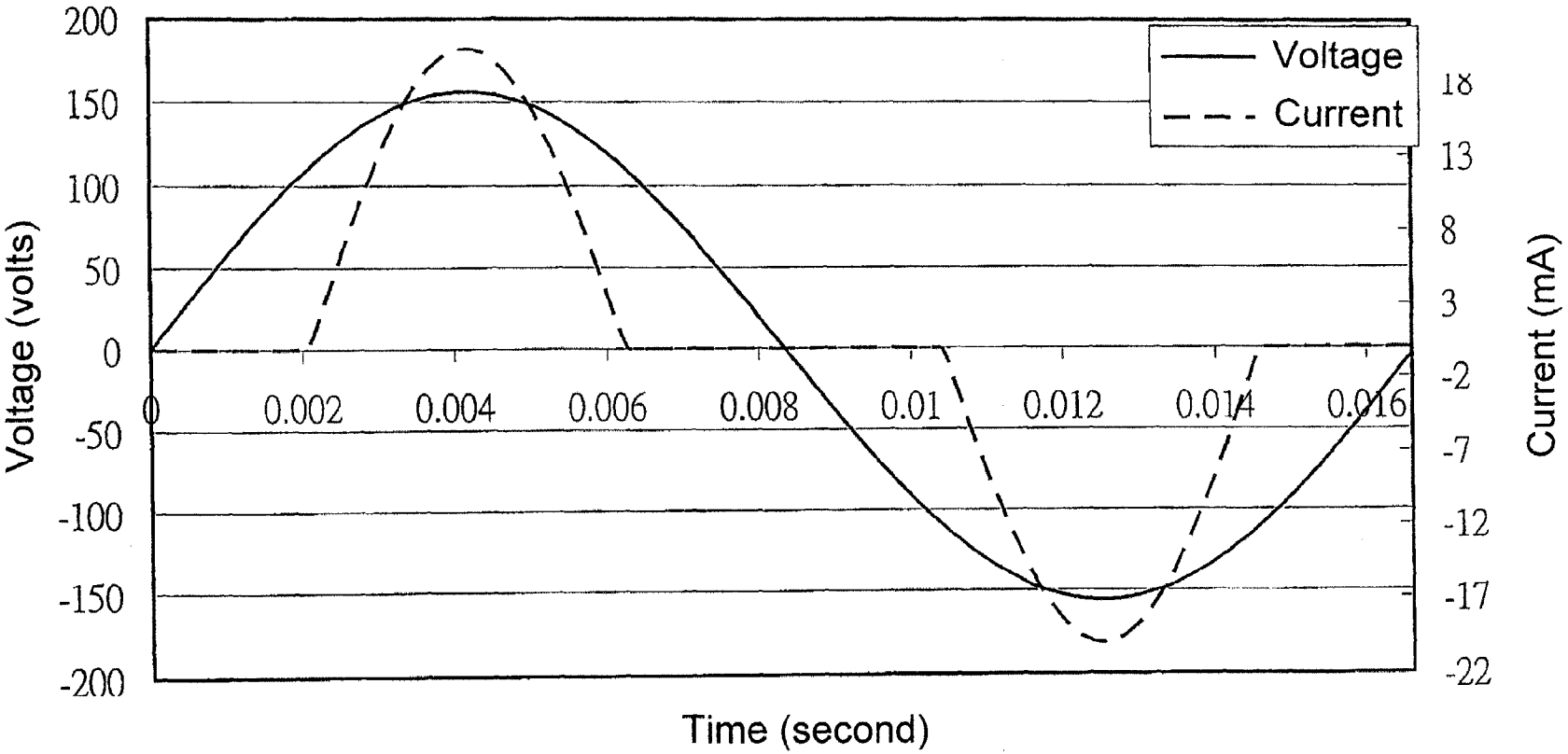
FIG. 1A (PRIOR ART)
FIG. 1A (Prior Art) shows waveforms of an input voltage and a current in a conventional diode light emitting device.
Figure 1B:
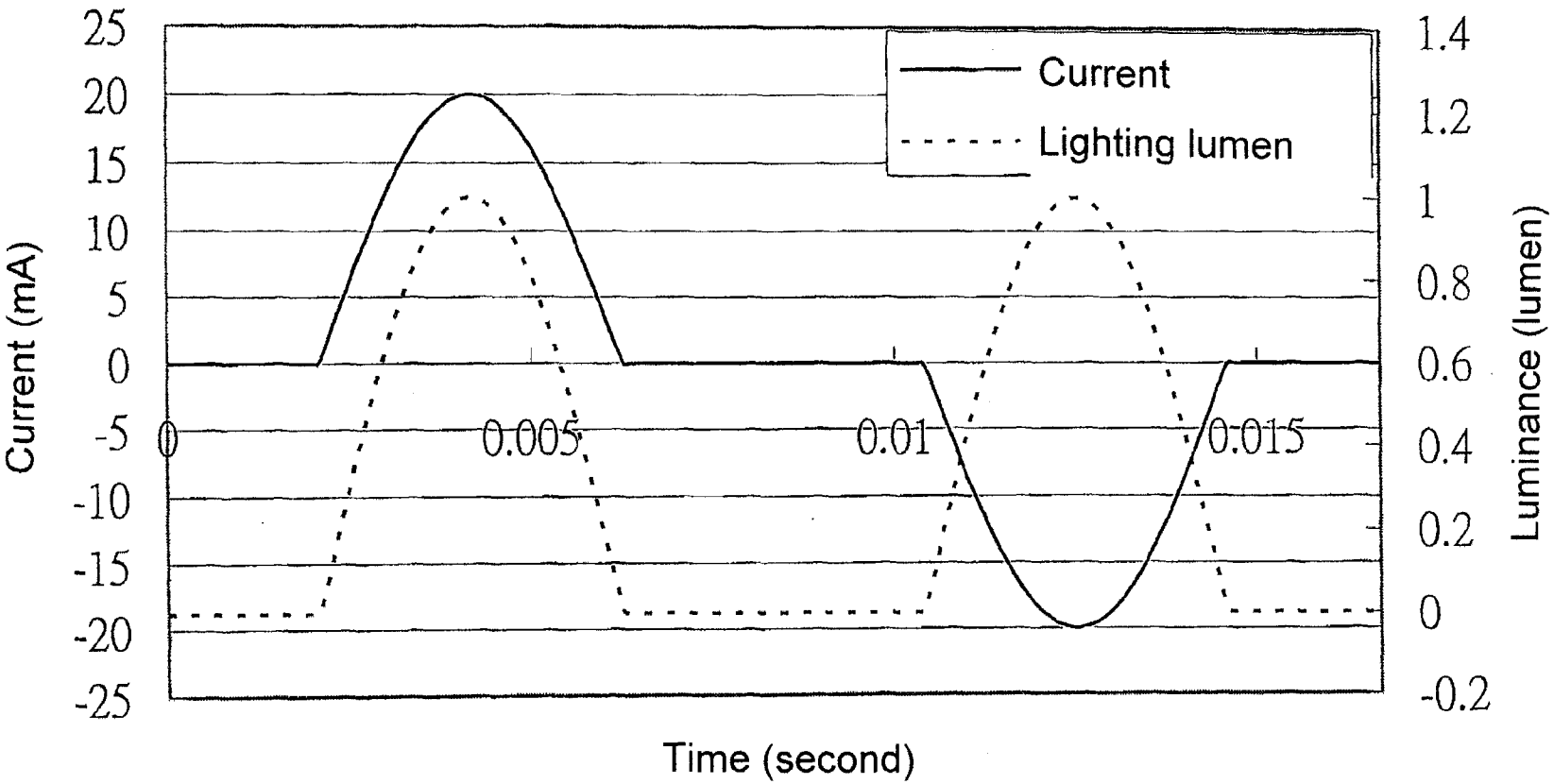
FIG. 1B(PRIOR ART)
FIG. 1B (Prior Art) shows waveforms of the current and a light output of an AC LED module in the conventional diode light emitting device.
Figure 2:
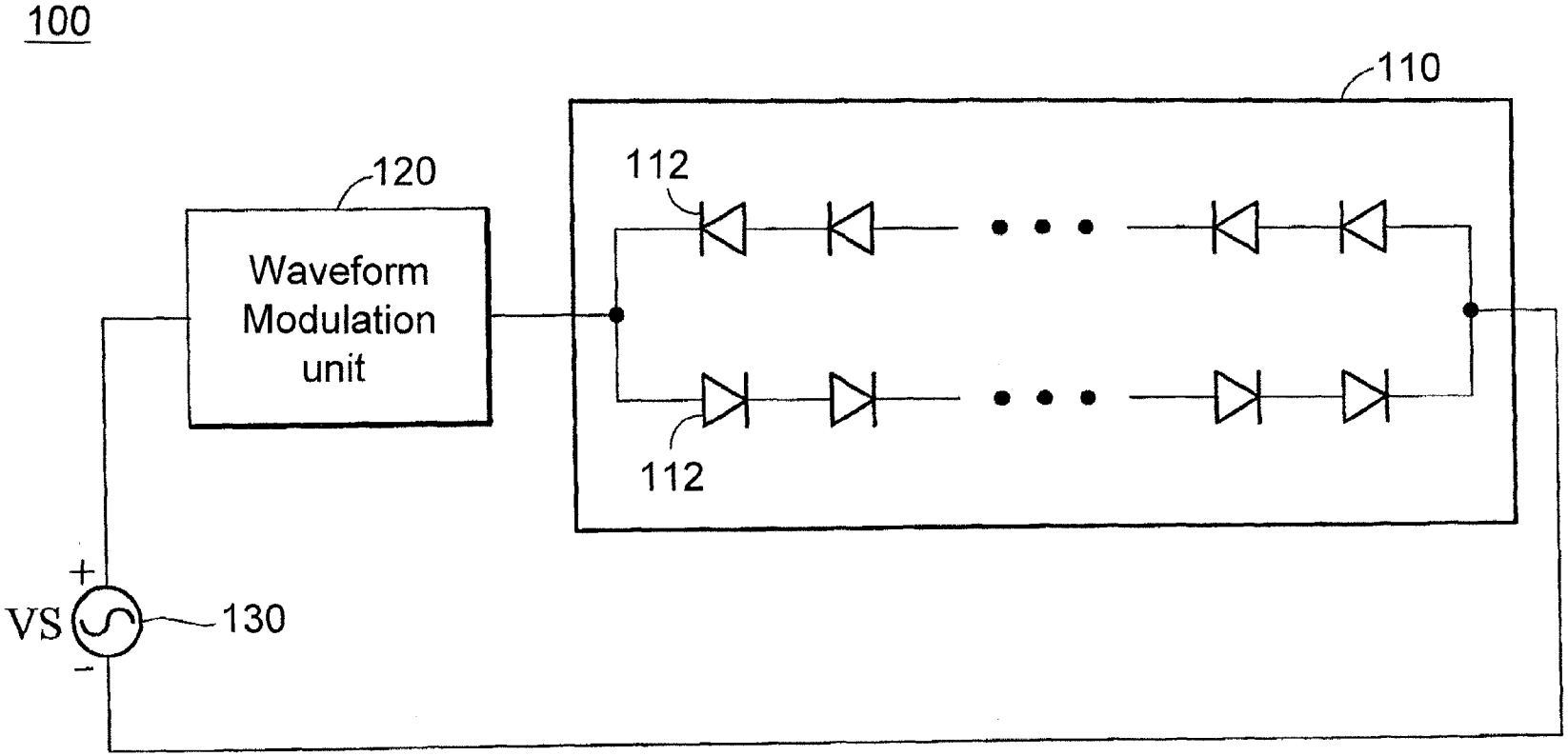
FIG. 2 is a schematic illustration showing an alternating current light emitting device according to a first embodiment of the invention.

FIG. 2 is a schematic illustration showing an alternating current light emitting device 100 according to a first embodiment of the invention. Referring to FIG. 2, the alternating current light emitting device 100 includes an AC light emitting diode (LED) module 110 and a waveform modulation unit 120. The AC LED module 110 includes multiple micro-diodes 112, which are formed on a substrate (not shown) and are connected to form two strings (two sets) via wires on the substrate. In addition, the micro-diode 112 may be a lighting element having the operation power that may be adjusted according to different threshold voltage. For example, the micro-diode 112 may be, without limitation to, a micro light emitting diode (micro LED) or a micro laser diode (micro LD).

In general, the alternating current light emitting device is packaged into a package, which includes fluorescent powder capable of mixing the light outputted from the micro-diodes into other colors of light. In this embodiment, the overall threshold voltage of each string of micro-diodes 112 is, without limitation to, about 90V. In a positive half cycle of an AC voltage source 130, when an input voltage VS is higher than 90V, the currents flow through the lower string of micro-diodes 112 in the AC LED module 110 so that the lower string of micro-diodes 112 can emit light. Similarly, when the input voltage VS is lower than −90V in a negative half cycle of the AC voltage source 130, the currents flow through the upper string of micro-diodes 112 in the AC LED module 110 to make the AC LED module 110 emit light.

Figure 3A:
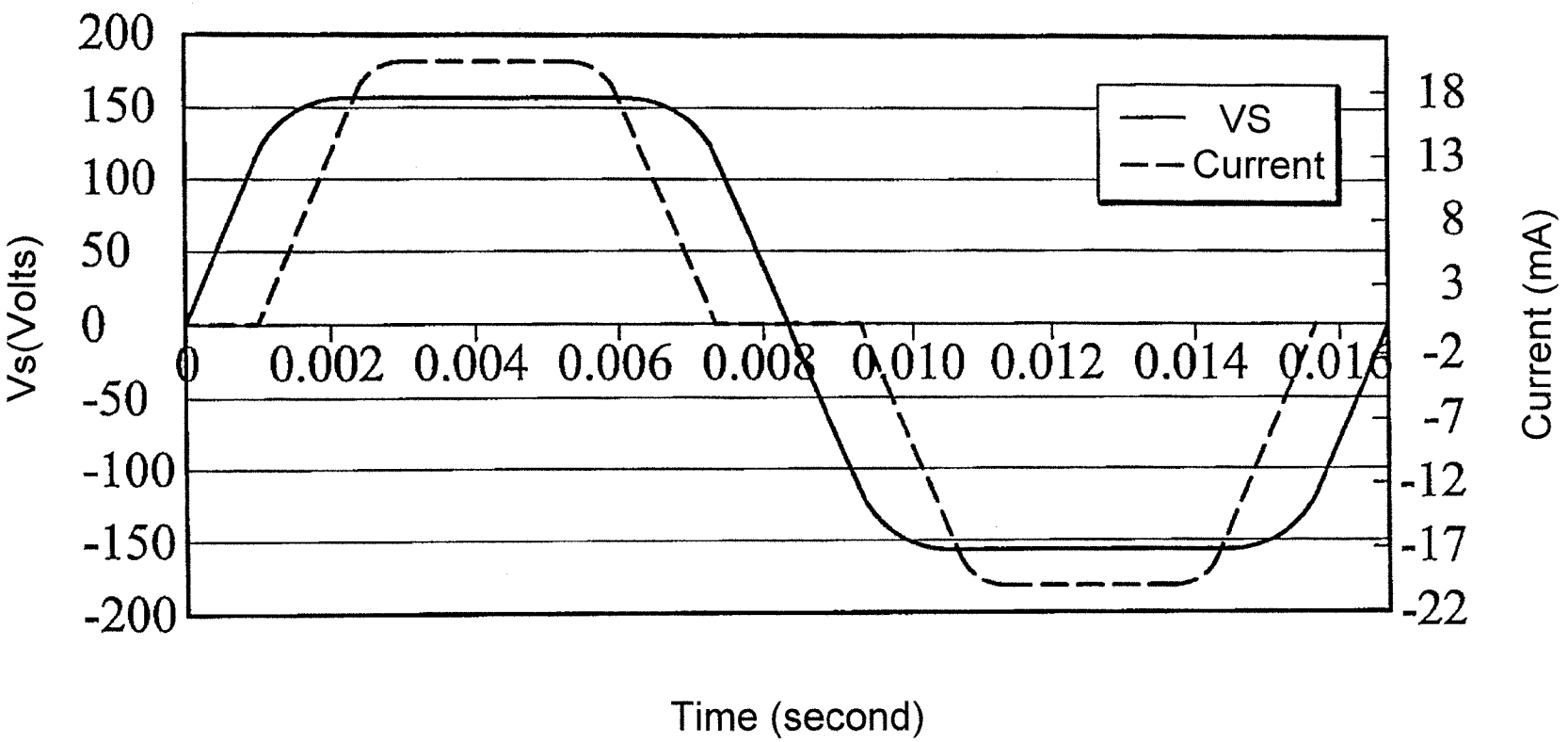
FIG. 3A shows waveforms of an input voltage and a current provided by an AC voltage source after the processing of a waveform modulation unit according to an example of the first embodiment of the invention.

The waveform modulation unit 120 coupled between the AC LED module 110 and the AC voltage source 130 increases a full width at half maximum (FWHM) of the input voltage VS provided by the AC voltage source 130. FIG. 3A shows waveforms of an input voltage and a current provided by the AC voltage source after the processing of the waveform modulation unit according to an example of the first embodiment of the invention. Referring to FIG. 3A, after the waveform modulation unit 120 increases the full width at half maximum (FWHM) of the input voltage VS, the time, for which the input voltage VS is higher than the threshold voltage (about 90V), is lengthened. For example, in the period when the input voltage VS is higher than 90V (about t=0.001 to 0.007 seconds) in the positive half cycle of the AC voltage source 130, the current flows through the lower string of micro-diodes 112 in the AC LED module 110. Similarly, in the period when the input voltage VS is lower than −90V (about t=0.009 to 0.015 seconds) in the negative half cycle of the AC voltage source 130, the current flows through the upper string of micro-diodes 112 in the AC LED module 110. Because the total time for which the current flows through the micro-diode 112, is lengthened, the real power of the AC LED module 110 is increased and the power factor is also increased therewith.

Figure 3B:
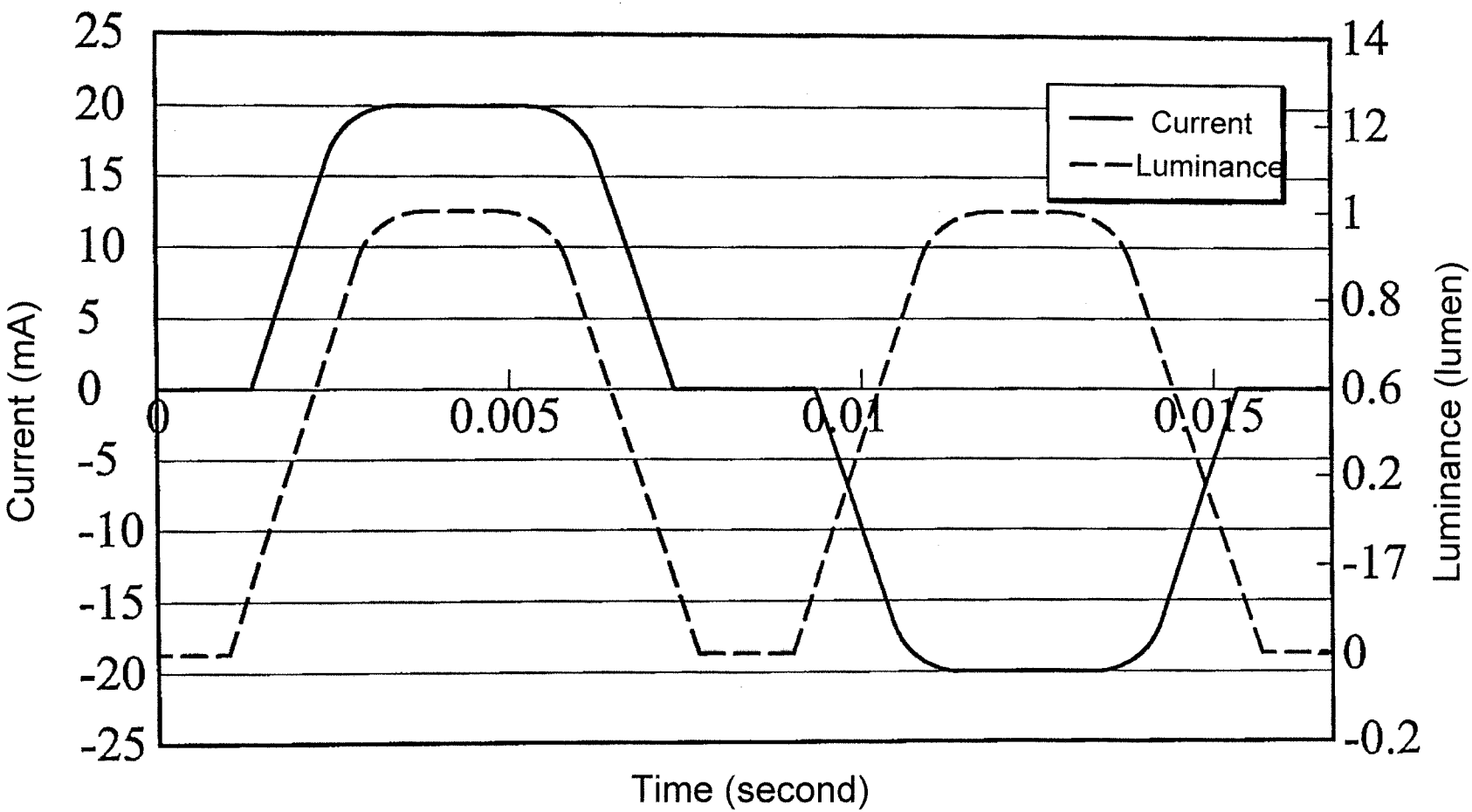
FIG. 3B shows a waveform of a current flowing through the AC LED module and a waveform of a light output thereof after the processing of the waveform modulation unit according to an example of the first embodiment of the invention.

FIG. 3B shows a waveform of a current flowing through the AC LED module and a waveform of a light output thereof after the processing of the waveform modulation unit according to an example of the first embodiment of the invention. As shown in FIG. 3B, the current flowing through the AC LED module 110 is increased with the increase of the full width at half maximum (FWHM) of the input voltage VS. So, the period, in which the AC LED module 110 emits light, is also lengthened. For example, in the periods from t=0.002 to 0.006 seconds and from about t=0.010 to 0.015 seconds, the AC LED module 110 emits light. On the contrary, the AC LED module 110 does not emit light only in the period from 0.075 to 0.090 seconds. That is, the proportion of the micro-diodes, which do not emit light, is decreased, so the flicker extent is also decreased.

Figure 4A:
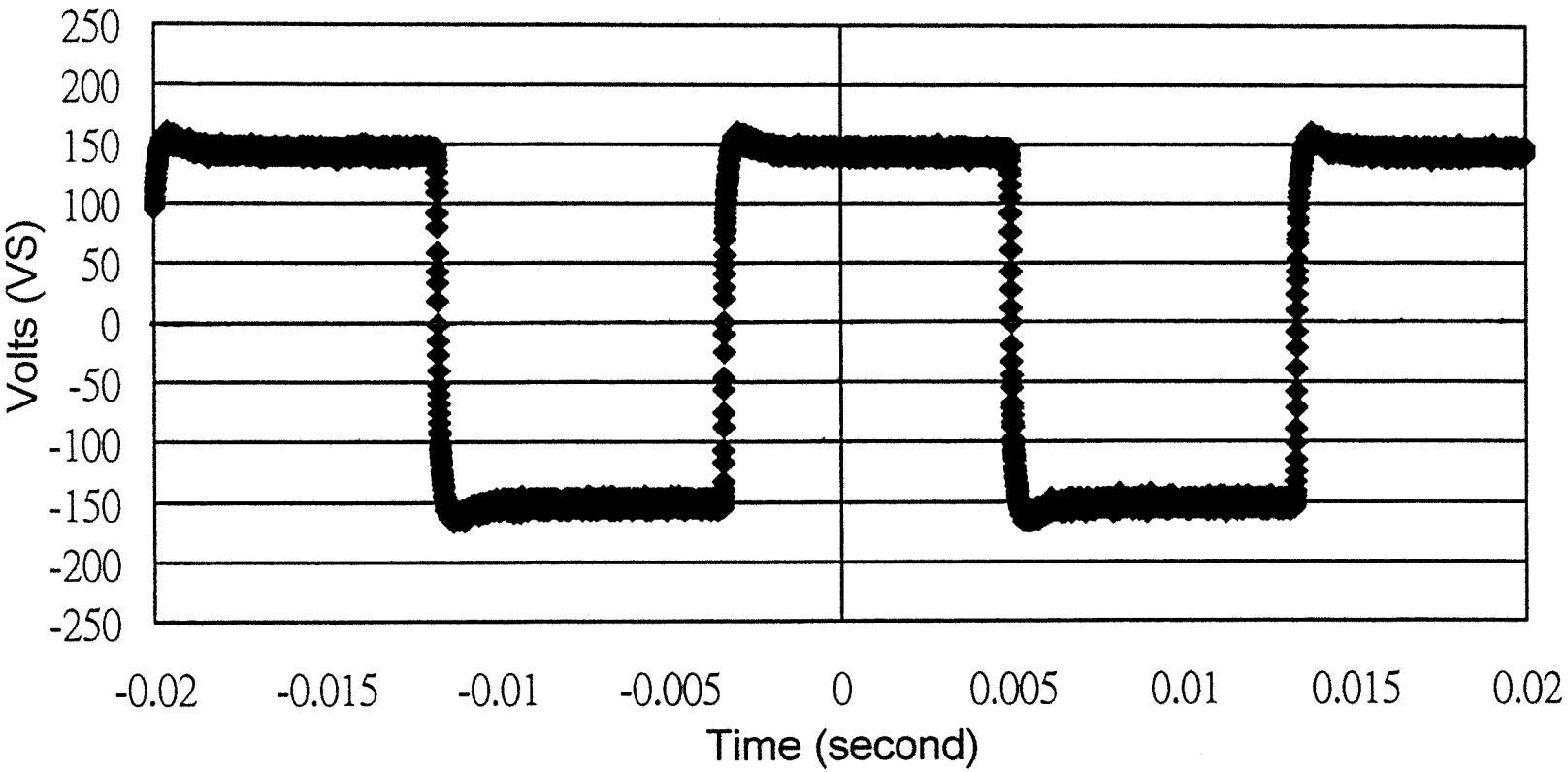
FIG. 4A shows waveforms of the input voltage and the current provided by the AC voltage source after the processing of the waveform modulation unit according to the other example of the first embodiment of the invention.

The waveform modulation unit 120 may also increase the full width at half maximum (FWHM) of the input voltage VS so that the waveform of the input voltage VS is converted from the sinusoidal waveform into the square wave waveform. FIG. 4A shows waveforms of the input voltage and the current provided by the AC voltage source after the processing of the waveform modulation unit according to the other example of the first embodiment of the invention. Consequently, the micro-diode 112 operates under the forward voltage in most of the time period. For example, the input voltage VS is higher than the threshold voltage (+90V) in almost the overall positive half cycle of the AC voltage source 130 so that the lower string of micro-diodes 112 in the AC LED module 110 of FIG. 2 is turned on. Similarly, the input voltage VS is lower than the threshold voltage (−90V) in almost the overall negative half cycle of the AC voltage source 130 so that the upper string of micro-diodes 112 in the AC LED module 110 of FIG. 2 is turned on.

Figure 4B:
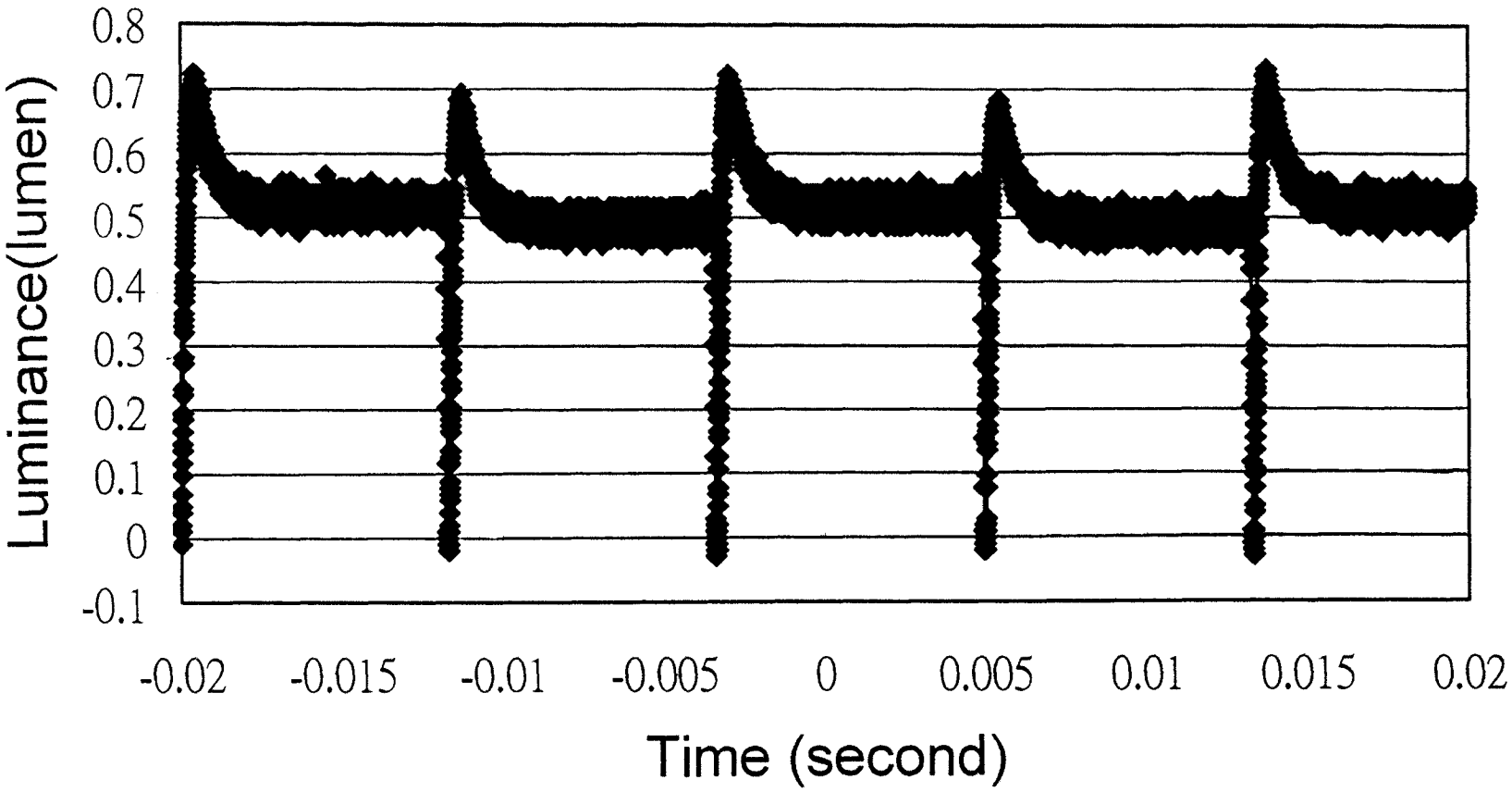
FIG. 4B shows the waveform of the light output of the AC LED module after the processing of the waveform modulation unit according to the other example of the first embodiment of the invention.

FIG. 4B shows the waveform of the light output of the AC LED module after the processing of the waveform modulation unit according to the other example of the first embodiment of the invention. As shown in FIG. 4B, the input voltage VS is almost higher than +90V in the positive half cycle of the AC voltage source 130, and is almost lower than −90V in the negative half cycle of the AC voltage source 130. So, the time, for which the current flows through the AC LED module 110, is lengthened. Thus, the period, in which the AC LED module 110 emits light, is also lengthened therewith. After the time, in which the AC LED module 110 does not emit light, is shortened, the flicker extent is reduced therewith.

Figure 5A:
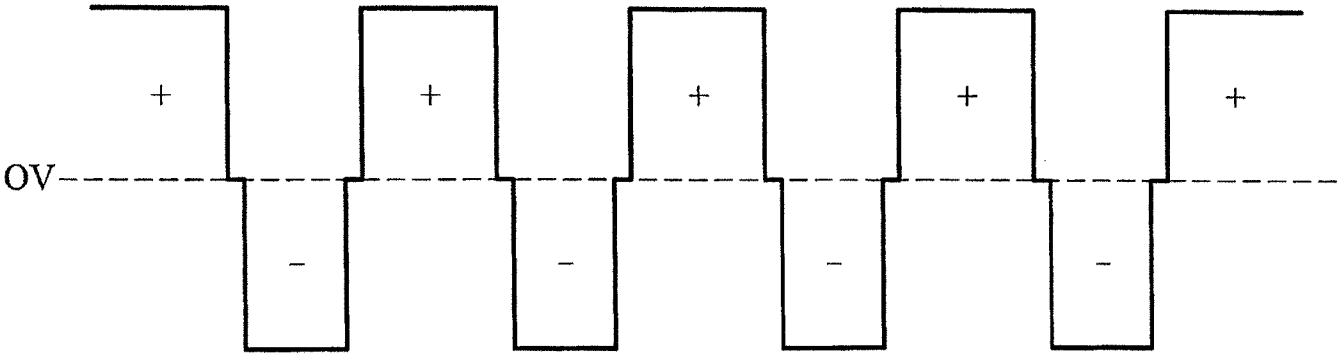
FIG. 5A shows another waveform of the input voltage provided by the AC voltage source after the processing of the waveform modulation unit according to the first embodiment of the invention.
Figure 5B:
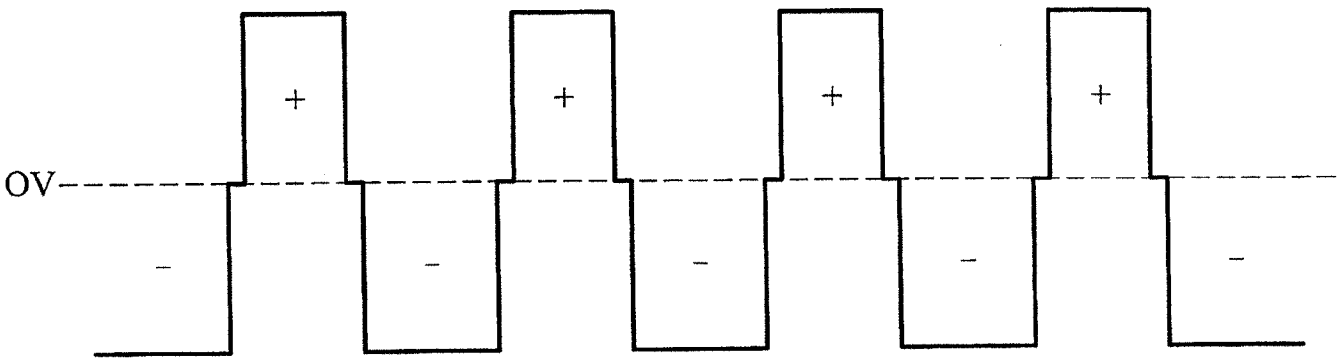
FIG. 5B shows another waveform of the input voltage provided by the AC voltage source after the processing of the waveform modulation unit according to the first embodiment of the invention.

In addition, the waveform modulation unit 120 may also modulate the waveform of the input voltage VS provided by the AC voltage source 130 from the sinusoidal waveform into the square wave, as shown in FIG. 5A or 5B. For example, when the waveform of the input voltage VS is modulated into the waveform of FIG. 5A, the lower string of micro-diodes 112 in the AC LED module 110 is turned on for a first time in the positive half cycle of the AC voltage source 130, and the upper string of micro-diodes 112 in the AC LED module 110 is turned on for a second time in the positive half cycle of the AC voltage source 130, wherein the first time is longer than the second time. In other words, the turn-on time of the AC LED module 110 in the positive half cycle of the AC voltage source 130 is longer than that in the negative half cycle.

As shown in FIG. 5B, the lower string of micro-diodes 112 in the AC LED module 110 is turned on for a first time in the positive half cycle of the AC voltage source 130, and the upper string of micro-diodes 112 in the AC LED module 110 is turned on for a second time in the positive half cycle of the AC voltage source 130, wherein the first time is shorter than the second time. In other words, the turn-on time of the AC LED module 110 in the negative half cycle of the AC voltage source 130 is longer than that in the positive half cycle.

In addition, the lower string of micro-diodes 112 in the AC LED module 110 may output a first color of light, and the upper string of micro-diodes 112 in the AC LED module 110 may output a second color of light. Therefore, the invention can achieve the color mixing effect by changing the turn-on times of the positive and negative half cycles of the AC voltage source 130, as shown in FIGS. 5A and 5B.

Figure 6A:
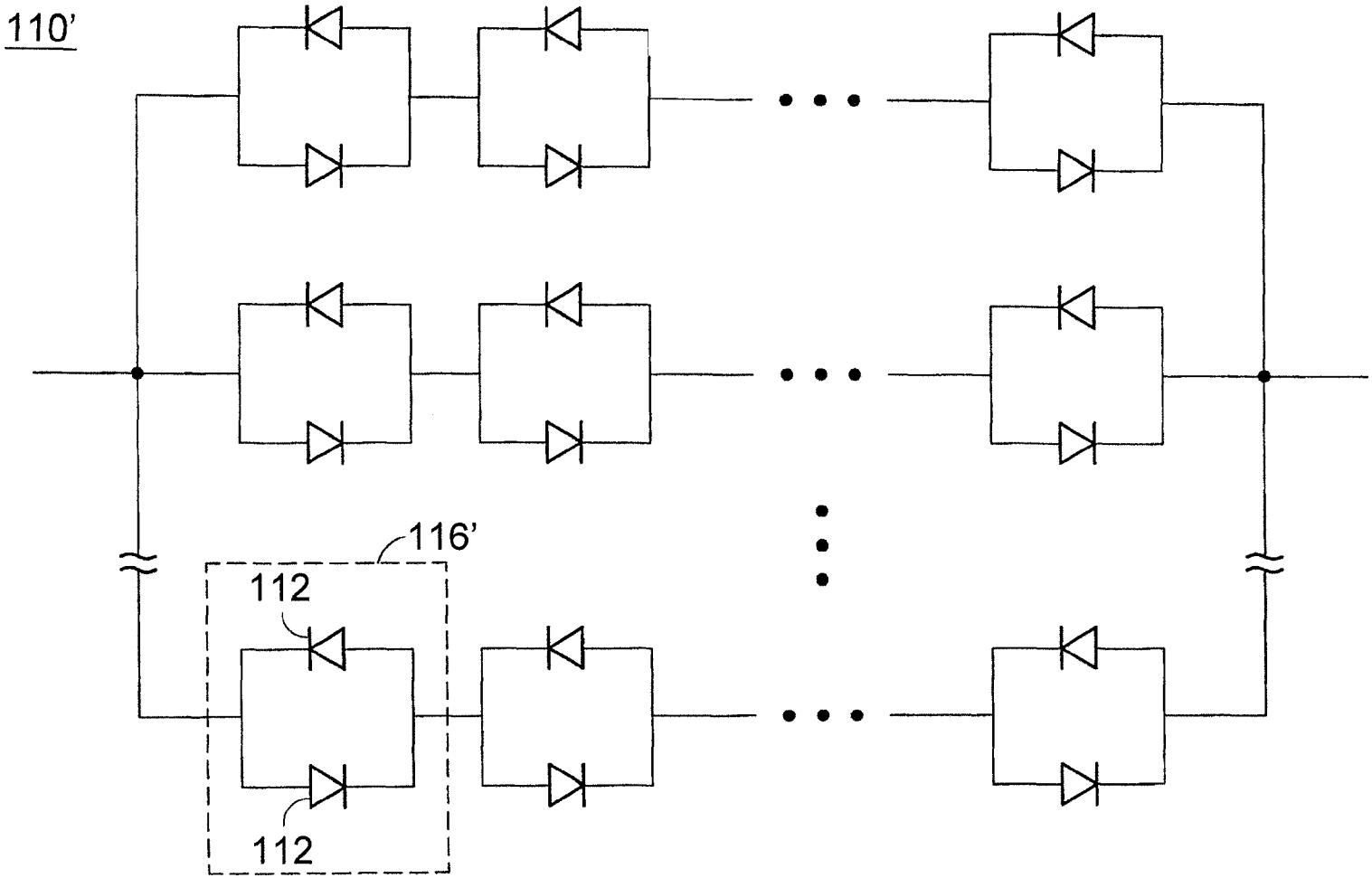
FIG. 6A is another schematic illustration showing the AC LED module according to the first embodiment of the invention.

FIG. 6A is another schematic illustration showing an AC LED module 110' according to the first embodiment of the invention. As shown in FIG. 6A, the micro-diodes 112 in the AC LED module 110' are connected to form multiple strings of micro light emitting units 116. Each micro light emitting unit 116 includes two micro-diodes 112 connected in anti-parallel. Each micro light emitting unit 116 may include more micro-diodes 112 connected in parallel, in series, or in series and parallel without any limitative purpose.

Figure 6B:
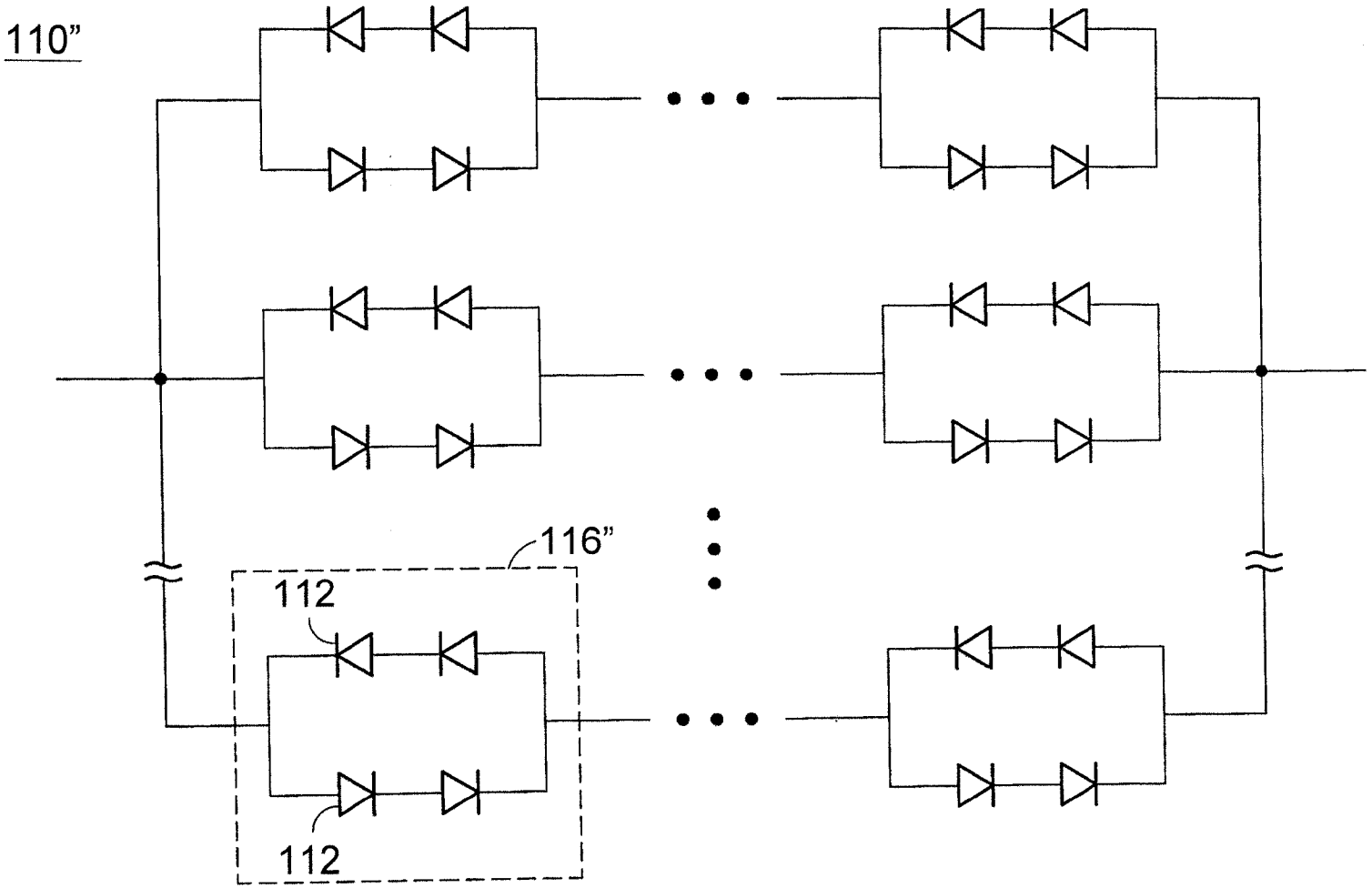
FIG. 6B is still another schematic illustration showing the AC LED module according to the first embodiment of the invention.

FIG. 6B is still another schematic illustration showing an AC LED module 110" according to the first embodiment of the invention. As shown in FIG. 6B, the micro-diodes 112 in the AC LED module 110" are connected to form multiple stings of micro light emitting units 116'. In each micro light emitting unit 116', two micro-diodes 112 are connected in series and then connected to other two micro-diodes 112 in parallel without any limitative purpose.

Figure 6C:
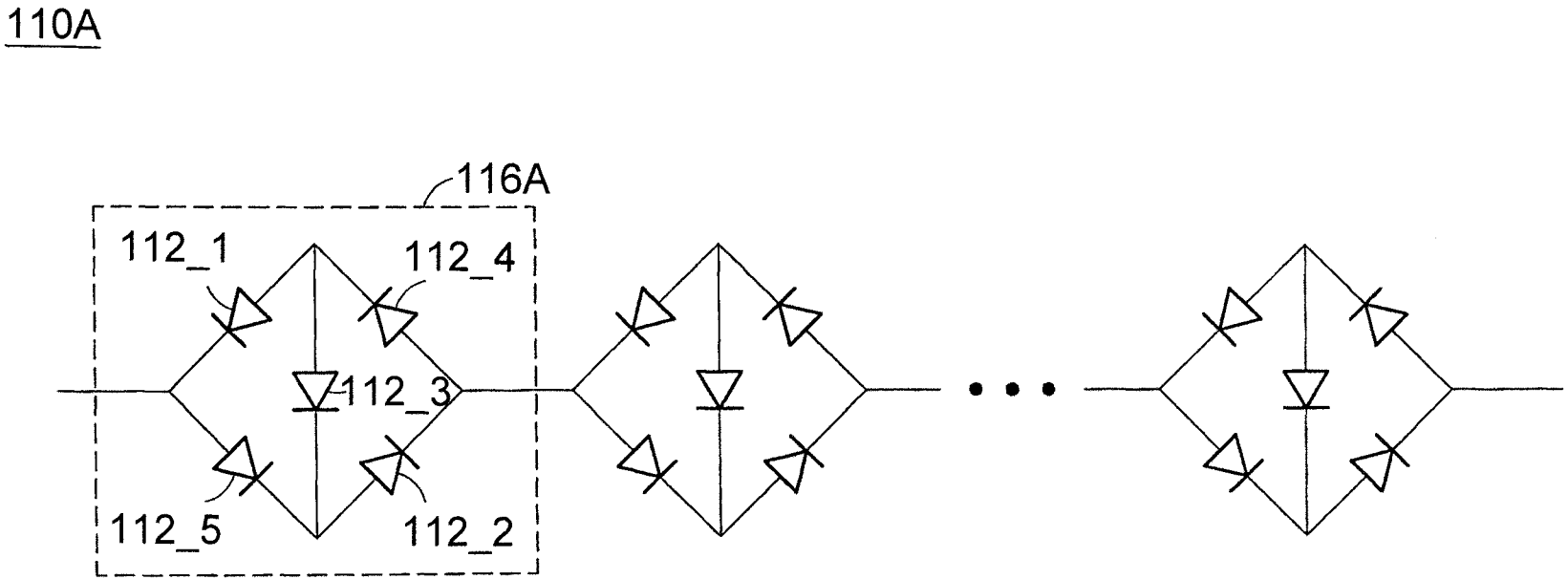
FIG. 6C is yet still another schematic illustration showing the AC LED module according to the first embodiment of the invention.

FIG. 6C is yet still another schematic illustration showing an AC LED module 110A according to the first embodiment of the invention. As shown in FIG. 6C, the AC LED module 110A includes a plurality of micro light emitting units 116A connected in series. Each of the micro light emitting units 116A includes micro-diodes 112_1 to 112_5 connected as a bridge circuit, wherein each branch of the bridge structure may also be replaced with multiple micro diodes connected in series, in parallel or in series and in parallel without any limitative purpose. For example, in the positive half cycle of the AC voltage source 130, the micro-diodes 112_1 to 112_3 are turned on for a first time in each micro light emitting unit 116A. In the negative half cycle of the AC voltage source 130, the micro-diodes 112_3 to 112_5 in each micro light emitting unit 116A are turned on for a second time, wherein the first time may be different from the second time. That is, the micro-diodes 112_1 to 112_3 in each micro light emitting unit 116A are regarded as a first set of micro-diodes in the positive half cycle of the AC voltage source 130, and the micro-diodes 112_3 to 112_5 in each micro light emitting unit 116A are regarded as a second set of micro-diodes in the negative half cycle of the AC voltage source 130. The micro-diode 112_3 is shared in the positive and negative half cycles of the AC voltage source 130.

Figure 6D:
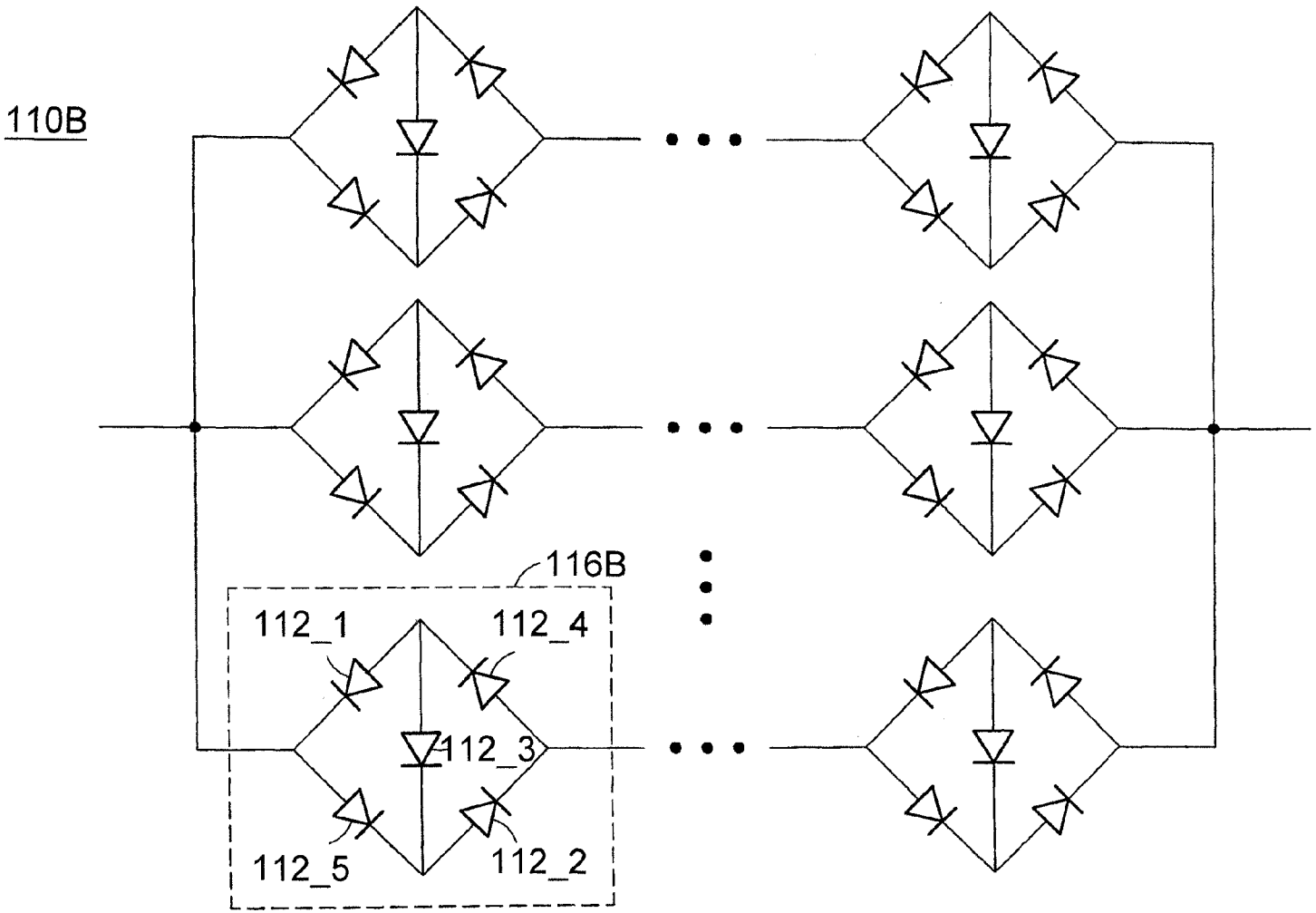
FIG. 6D is yet still another schematic illustration showing the AC LED module according to the first embodiment of the invention.

FIG. 6D is yet still another schematic illustration showing an AC LED module 110B according to the first embodiment of the invention. Referring to FIG. 6D, the AC LED module 110B includes multiple strings of micro light emitting units 116A. Each micro light emitting unit 116A includes micro-diodes 112_1 to 112_5 connected as a bridge circuit. Similarly, the micro-diodes 112_1 to 112_3 in each micro light emitting unit 116A are turned on for a first time in the positive half cycle of the AC voltage source 130, and the micro-diodes 112_3 to 112_5 in each micro light emitting unit 116A are turned on for a second time in the negative half cycle of the AC voltage source 130.

Second Embodiment

Figure 7:
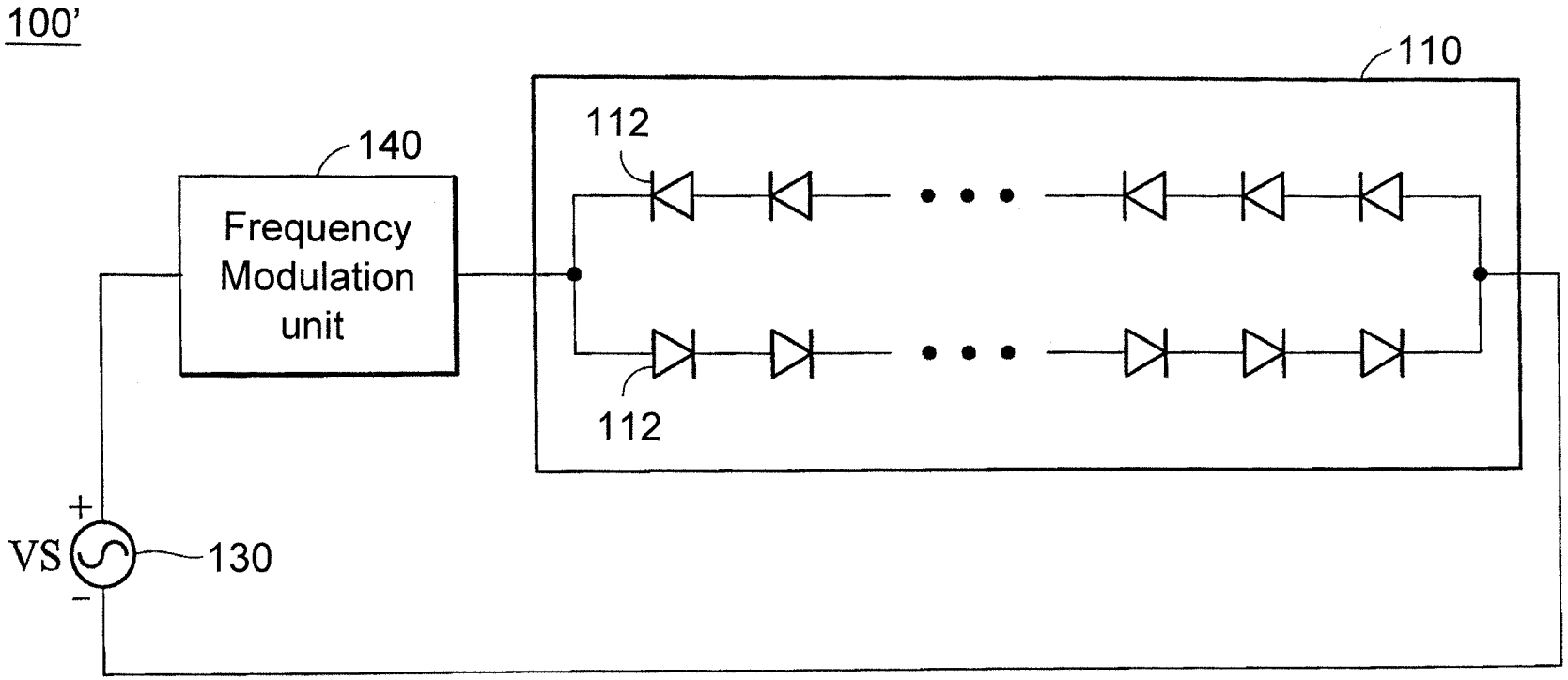
FIG. 7 is a schematic illustration showing an alternating current light emitting device according to a second embodiment of the invention.

FIG. 7 is a schematic illustration showing an alternating current light emitting device 100' according to a second embodiment of the invention. As shown in FIG. 7, the alternating current light emitting device 100' is similar to the alternating current light emitting device 100 of FIG. 2 except that the waveform modulation unit 120 is omitted and a frequency modulation unit 140 is used to adjust the voltage frequency of the AC voltage source 130. The frequency modulation unit 140 adjusts the voltage frequency of the AC voltage source 130 from 60 Hz to fall within the range between 60 Hz and 100 Hz so that the user cannot feel the phenomenon of flicker through the effect of eye persistence of vision. Preferably, the frequency modulation unit 140 increases the voltage frequency of the AC voltage source 130 to fall within the range between 100 Hz and 60 KHz. More preferably, the frequency modulation unit 140 adjusts the voltage frequency of the AC voltage source 130 to fall within the range between 100 Hz and 1 KHz.

Figure 8:
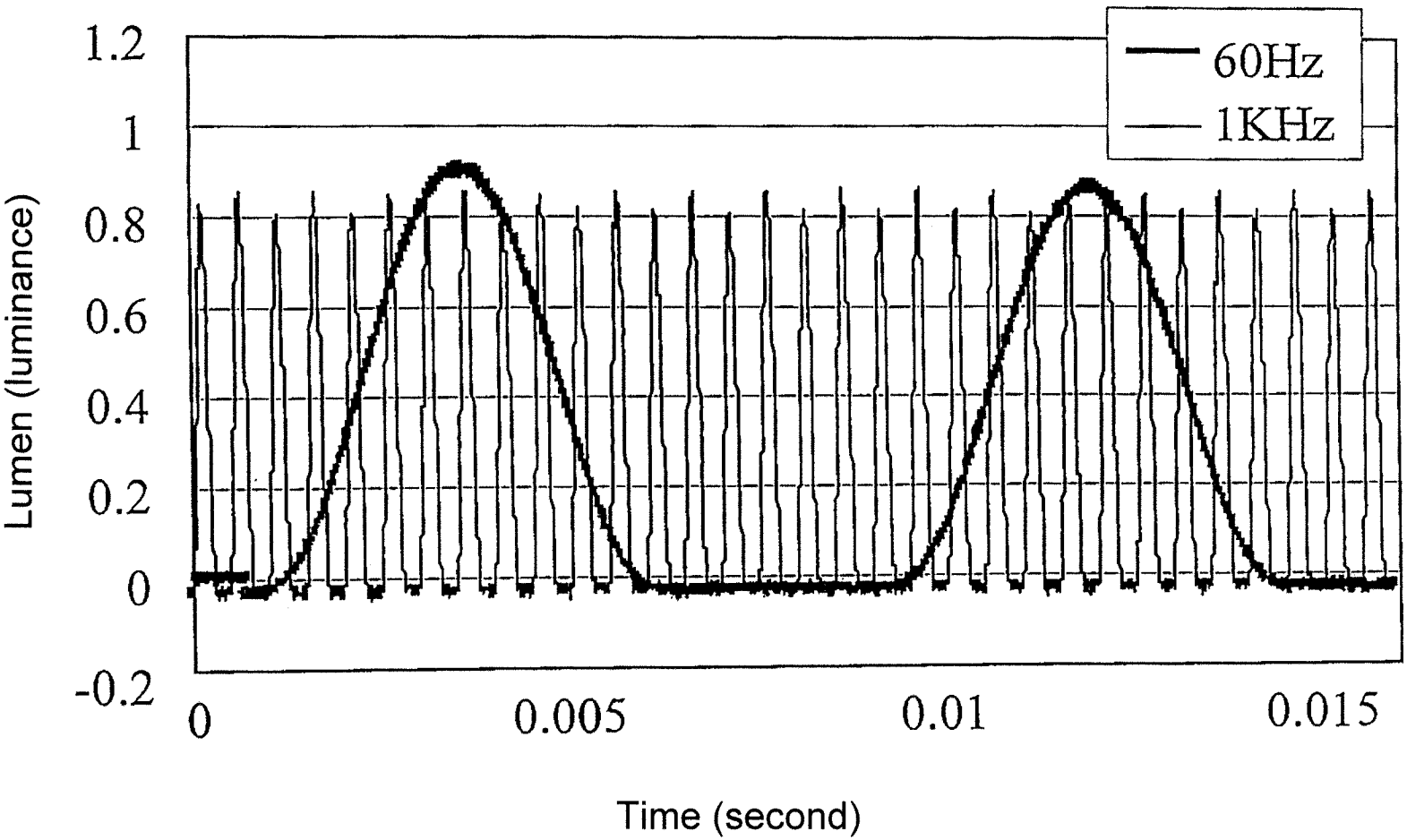
FIG. 8 shows the luminance of the alternating current light emitting device at different voltage frequencies according to the second embodiment of the invention.

FIG. 8 shows the luminance of the alternating current light emitting device at different voltage frequencies according to the second embodiment of the invention. As shown in FIG. 8, when the voltage frequency of the AC voltage source 130 is increased to 1 KHz, the light emitting interval of the alternating current light emitting device 100' is smaller than the range which can be sensed by the human eyes. Thus, the invention can improve the phenomenon of flicker sensed by the human eyes due to the delay effect when the micro-diodes are used in conjunction with the fluorescent powder.

Third Embodiment

Figure 9:
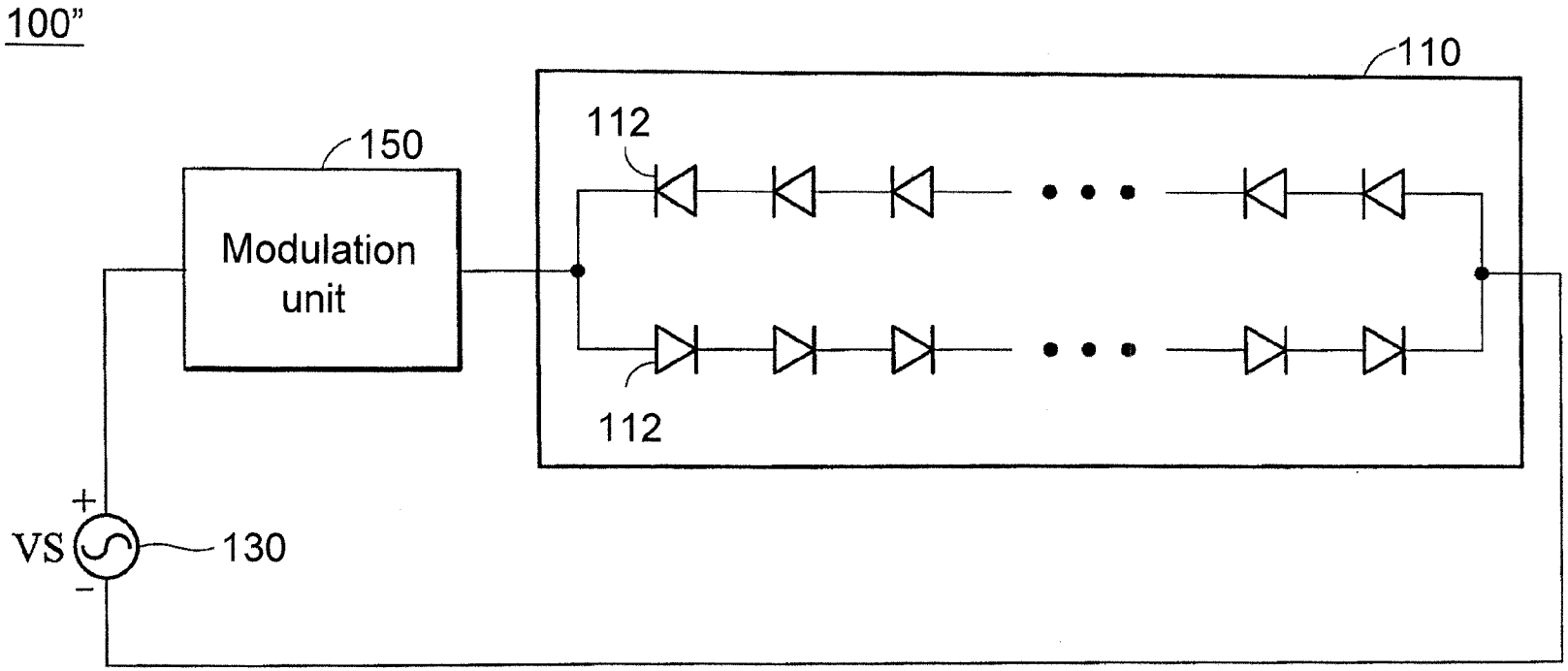
FIG. 9 is a schematic illustration showing an alternating current light emitting device according to a third embodiment of the invention.

FIG. 9 is a schematic illustration showing an alternating current light emitting device 100" according to a third embodiment of the invention. Referring to FIG. 9, the alternating current light emitting device 100" includes a modulation unit 150 for increasing the full width at half maximum (FWHM) of the input voltage VS provided by the AC voltage source 130, and increasing the voltage frequency of the AC voltage source 130 so as to increase the power factor of the alternating current light emitting device 100" and improve the phenomenon of flicker sensed by the user simultaneously.

The waveform modulation unit 120 of FIG. 2 (or the frequency modulation unit 140 of FIG. 7 and the modulation unit 150 of FIG. 9) and the AC LED module 110 may be disposed on different chips or integrated within the same chip. In addition, the waveform modulation unit 120 of FIG. 2 (or the frequency modulation unit 140 of FIG. 7 and the modulation unit 150 of FIG. 9) may also be disposed outside the package of the AC LED module 110 or disposed inside the package of the micro-diodes 112 of the AC LED module 110 without any limitative purpose.

Fourth Embodiment

Figure 10:
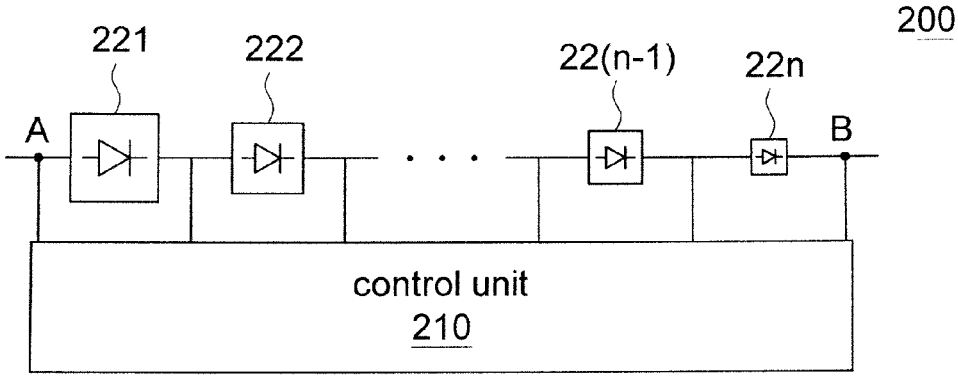
FIG. 10 is a schematic illustration showing an alternating current light emitting device according to a first example of a fourth embodiment of the invention.

FIG. 10 is a schematic illustration showing an alternating current light emitting device 200 according to a first example of a fourth embodiment of the invention. Referring to FIG. 10, the alternating current light emitting device 200 includes a control unit 210 and a plurality of LEDs 221 to 22*n*. At least some of the LEDs 221 to 22*n* have different micro diode areas. The control unit 210 controls the LEDs 221 to 22*n*. When the LEDs 221 to 22*n* are driven by an AC voltage source, the control unit 210 sequentially turns on the LEDs with different micro diode areas according to the voltage of the AC voltage source. In FIG. 10, the micro diode areas of the LEDs are different from one another without any limitative purpose. The LEDs 221 to 22*n* are connected in series, and the anode and the cathode of each LED are electrically connected to the control unit 210. The control unit 210 and the LEDs 221 to 22*n* may be integrated within a chip or a package, or the control unit 210 may be disposed outside the package without any limitative purpose.

The micro diode area of the LED is inversely proportional to the impedance of the LED. That is, the LED having the larger micro diode area has the lower impedance. On the contrary, the LED having the smaller micro diode area has the higher impedance. In FIG. 10, the node A and the node B are electrically connected to an AC voltage source (not shown). When the LEDs 221 to 22*n* are driven by the AC voltage source, the control unit 210 firstly turns on the LED (e.g., the LED 221 or 222) with the larger micro diode area and does not turn on the LED (e.g., the LED 22(*n*-1) or 22*n*) with the smaller micro diode area when the voltage of the AC voltage source is lower. At this time, the threshold voltage of the LED 221 or 222 is not high although the voltage of the AC voltage source is lower, so the current flows through the LED 221 or 222 to make the LED emit light.

Next, when the voltage of the AC voltage source is increased, the control unit 210 turns on the LED having the micro diode area smaller than that of the LED 221 or 222 so that the total impedance of the turn-on LED string is increased with the increase of the voltage of the AC voltage source. Thus, the turn-on current cannot vary severely with the variation of the alternating current voltage and can be held at the relatively stable state. Thereafter, when the voltage of the AC voltage source is higher, the control unit 210 further turns on the LED (e.g., the LED 22(*n*-1) or 22*n*) with the smaller micro diode area (i.e., the higher impedance). That is, the control unit 210 sequentially turns on the LEDs with different micro diode areas according to the voltage of the AC voltage source.

Figure 11:
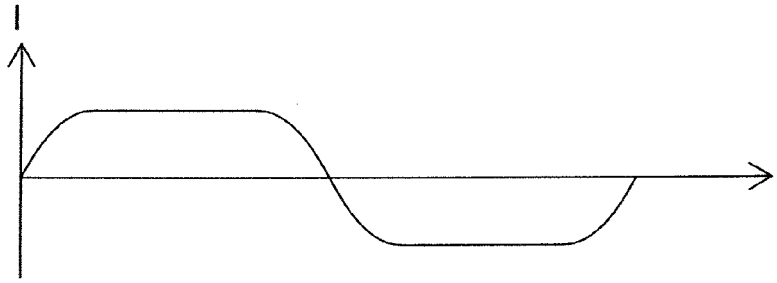
FIG. 11 is a schematic illustration showing a current of the alternating current light emitting device according to the fourth embodiment of the invention.

FIG. 11 is a schematic illustration showing the current of the alternating current light emitting device according to the fourth embodiment of the invention. As shown in FIG. 11, the control unit 210 only turns on the LED with the larger micro diode area when the voltage of the AC voltage source is lower, so the current flows through the LED to make the LED emit light when the corresponding driving voltage is low. In addition, the control unit 210 sequentially turns on the LEDs with different micro diode areas according to the increase of the voltage of the AC voltage source so that the impedance of the LED string is also increased with the increase of the voltage of the AC voltage source. Thus, the currents flowing through the LEDs gradually become uniform, as shown in FIG. 11. Consequently, the alternating current light emitting device 200 may have the high light emitting efficiency, and the problem of flicker of light emitting may also be improved.

In addition, the control unit 210 can control the direction of the AC voltage source so that the LEDs 221 to 22*n* are biased by positive voltage in either the positive half cycle or the negative half cycle of the AC voltage source. In addition, it is also possible to use other methods such that the control unit 210 can be simplified because it is unnecessary to control the direction of the AC voltage source.

Figure 12:
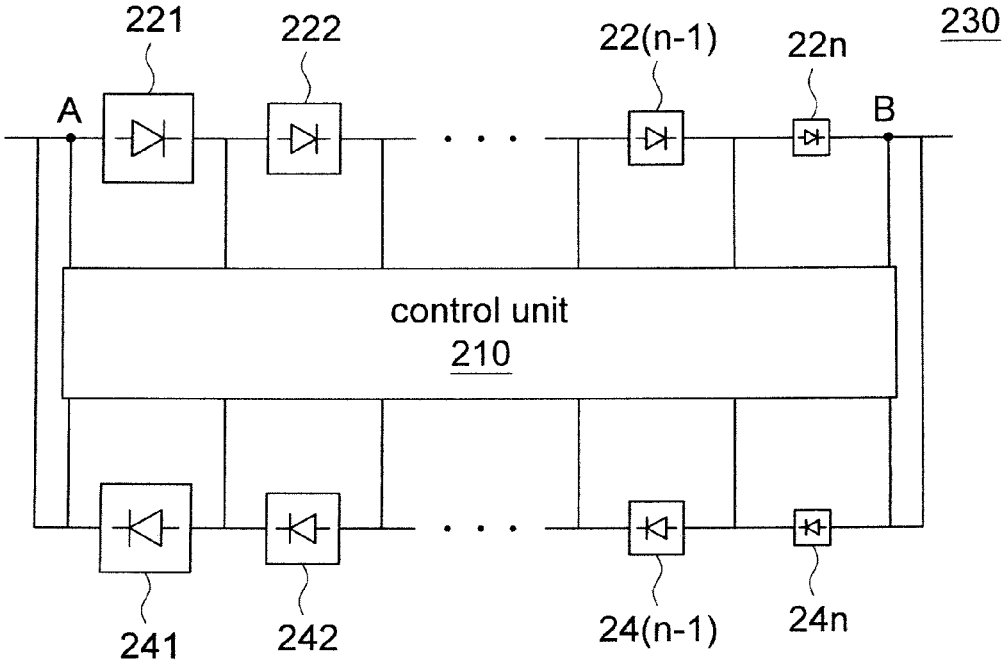
FIG. 12 is a schematic illustration showing an alternating current light emitting device according to a second example of the fourth embodiment of the invention.

FIG. 12 is a schematic illustration showing an alternating current light emitting device 230 according to a second example of the fourth embodiment of the invention. Compared with the alternating current light emitting device 200, the alternating current light emitting device 230 further includes additional LEDs 241 to 24*n*. The LEDs 241 to 24*n* are connected in series and are connected in anti-parallel with the LEDs 221 to 22*n*, which are connected in series. The anode and the cathode of each of the LEDs 241 to 24*n* are electrically connected to the control unit 210, and at least some of the LEDs 241 to 24*n* have different micro diode areas. The LEDs 221 to 22*n* are driven in the positive half cycle of the AC voltage source, and the LEDs 241 to 24*n* are driven in the negative half cycle of the AC voltage source.

Figure 13:
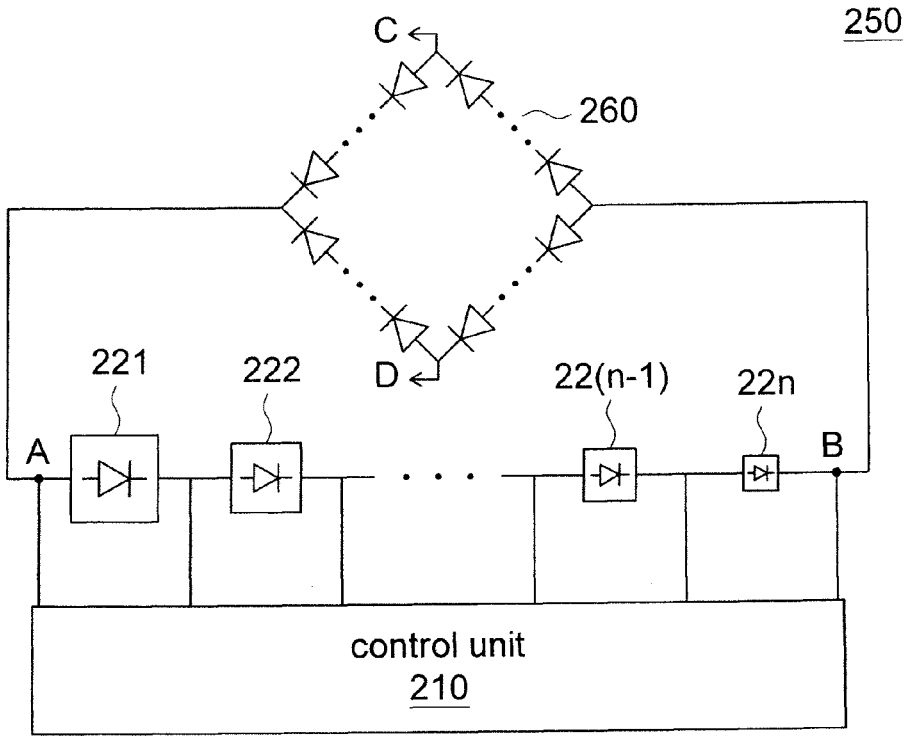
FIG. 13 is a schematic illustration showing an alternating current light emitting device according to a third example of the fourth embodiment of the invention.

FIG. 13 is a schematic illustration showing an alternating current light emitting device 250 according to a third example of the fourth embodiment of the invention. Compared with the alternating current light emitting device 200, the alternating current light emitting device 250 further includes a bridge rectifier 260. The bridge rectifier 260, which is electrically connected to the node A and the node B and is electrically connected to the AC voltage source at the nodes C and D, rectifies the AC voltage source so that the LEDs 221 to 22*n* are biased by positive voltage.

In addition, the LEDs 221 to 22*n* and the LEDs 241 to 24*n* in FIGS. 10, 12 and 13 are arranged in order according to the sizes of the micro diode areas thereof. However, the invention is not limited thereto. The LEDs 221 to 22*n* and the LEDs 241 to 24*n* may also be arranged arbitrarily regardless of the sizes of the micro diode areas thereof as long as the control unit 210 can sequentially turn on the LEDs with different micro diode areas according to the voltage of the AC voltage source.

Figure 14:
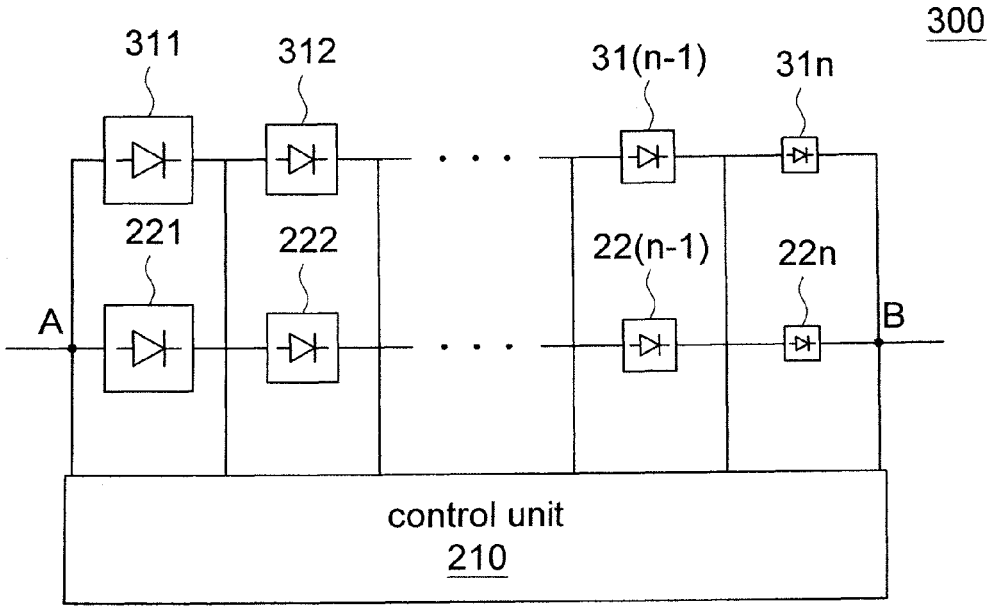
FIG. 14 is a schematic illustration showing an alternating current light emitting device according to a fourth example of the fourth embodiment of the invention.

In addition, the fourth embodiment of the invention is not restricted to the single serial LED. FIG. 14 is a schematic illustration showing an alternating current light emitting device 300 according to a fourth example of the fourth embodiment of the invention. In FIG. 14, each of the LEDs 221 to 22*n* of the alternating current light emitting device 300 is connected in parallel to the corresponding one of the LEDs 311 to 31*n* having the micro diode area the same as that of the LEDs 221 to 22*n*. For example, the LED 221 is connected in parallel to the LED 311, and the LED 22*n* is connected in parallel to the LED 31*n*. In FIG. 14, the numbers of LEDs connected to each of the LEDs 221 to 22*n* in parallel are the same. However, the invention is not limited thereto.

Figure 15:
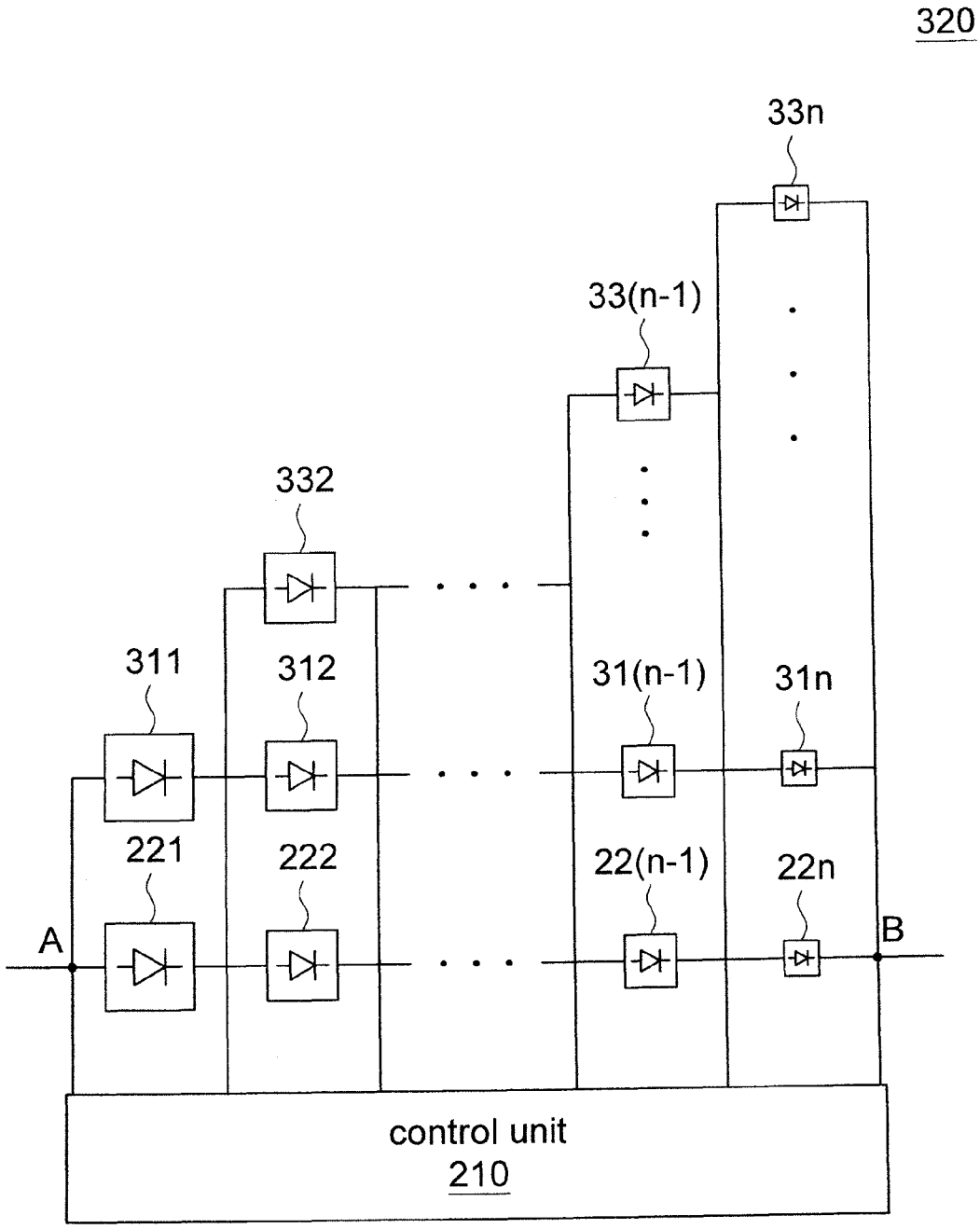
FIG. 15 is a schematic illustration showing an alternating current light emitting device according to a fifth example of the fourth embodiment of the invention.

FIG. 15 is a schematic illustration showing an alternating current light emitting device according to a fifth example of the fourth embodiment of the invention. As shown in FIG. 15, the numbers of LEDs connected to the LEDs 221 to 22*n* in parallel are different from each other, wherein the number of LEDs connected in parallel to the LED with the larger micro diode area is smaller, while the number of LEDs connected to the LED with the smaller micro diode area is greater. For example, the LED 221 with the larger micro diode area is only connected to the LED 311 in parallel, while the LED 22*n* with the smaller micro diode area is connected to the LEDs 31*n* to 33*n* in parallel. In addition, each LED may also be connected in parallel to the LED having the micro diode area different from that of the LED as long as the control unit 210 can sequentially turn on the LEDs with different micro diode areas according to the voltage of the AC voltage source.

Fifth Embodiment

Figure 16:
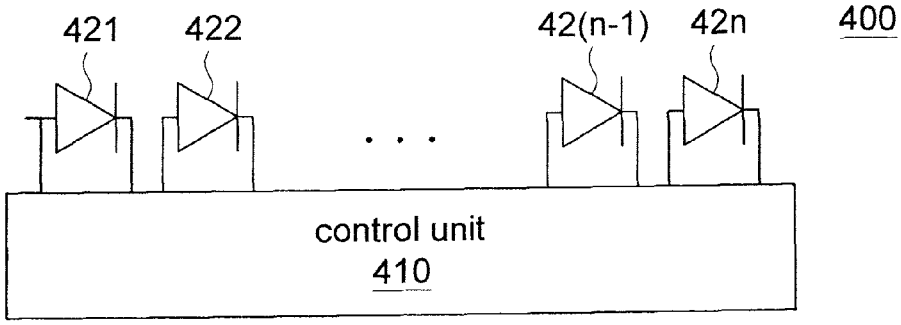
FIG. 16 is a schematic illustration showing an alternating current light emitting device according to a first example of a fifth embodiment of the invention.

FIG. 16 is a schematic illustration showing an alternating current light emitting device 400 according to a first example of a fifth embodiment of the invention. Referring to FIG. 16, the alternating current light emitting device 400 includes a control unit 410 and a plurality of LEDs 421 to 42*n*. The anode and the cathode of each of the LEDs 421 to 42*n* are electrically connected to the control unit 410. The control unit 410 and the LEDs 421 to 42*n* may be integrated within a chip or a package, or the control unit 410 may be disposed outside the package without any limitative purpose.

In FIG. 16, the node A and the node B are electrically connected to an AC voltage source (not shown). When the LEDs 421 to 42*n* are driven by the AC voltage source, the control unit 410 changes the serial or parallel connection states of the LEDs 421 to 42*n* according to the voltage of the AC voltage source so that the currents flowing through the LEDs 421 to 42*n* gradually become uniform.

Figure 17A:
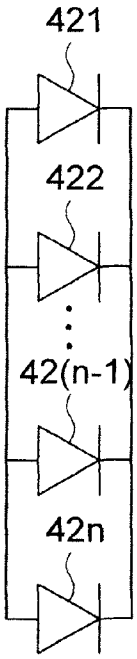
FIG. 17A shows an example of an equivalent state diagram of the LED according to the fifth embodiment of the invention.
Figure 17B:
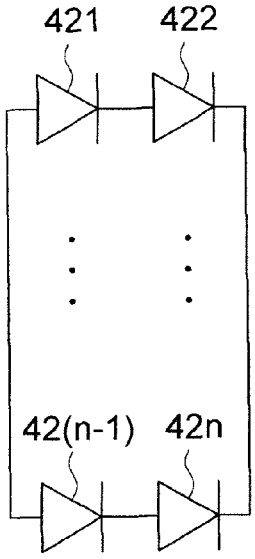
FIG. 17B shows another example of an equivalent state diagram of the LED according to the fifth embodiment of the invention.

FIG. 17A shows an example of an equivalent state diagram of the LED according to the fifth embodiment of the invention. FIG. 17B shows another example of an equivalent state diagram of the LED according to the fifth embodiment of the invention. When the voltage of the AC voltage source is lower, the control unit 410 can connect the LEDs 421 to 42*n* in parallel, as shown in FIG. 17A. Consequently, the overall threshold voltage of the LEDs 421 to 42*n* are not high, and the currents may flow through the LEDs to make the LEDs emit light.

Thereafter, when the voltage of the AC voltage source is increased, the serial or parallel connection states of the LEDs 421 to 42*n* may be changed. For example, each of pairs of LEDs is connected in series and then the pairs of the LEDs are connected in parallel, as shown in FIG. 17B. Consequently, the overall threshold voltage of the LEDs 421 to 42*n* still has the currents flowing therethrough with the increase of the voltage of the AC voltage source so that the LEDs 421 to 42*n* can emit light. In addition, because the impedance of each of the LEDs 421 to 42*n* is increased with the increase of the voltage of the AC voltage source, the currents flowing through the LEDs 421 to 42*n* gradually become uniform, as shown in FIG. 11. Consequently, the light emitting efficiency of the alternating current light emitting device 400 can be increased, and the problem of flicker of lighting may also be improved.

In addition, the control unit 410 can control the direction of the AC voltage source so that the LEDs 421 to 42*n* are biased by positive voltage in either the positive half cycle or the negative half cycle of the AC voltage source.

Sixth Embodiment

Figure 18:
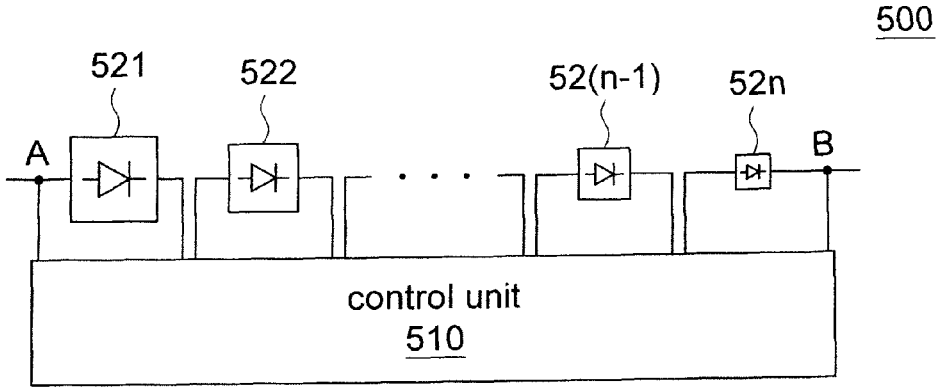
FIG. 18 is a schematic illustration showing an alternating current light emitting device according to a first example of a sixth embodiment of the invention.

The technological features of the fourth and fifth embodiments of the invention may be implemented alone or in conjunction with each other. FIG. 18 is a schematic illustration showing an alternating current light emitting device 500 according to a first example of a sixth embodiment of the invention. Referring to FIG. 18, the alternating current light emitting device 500 includes a control unit 510 and a plurality of LEDs 521 to 52*n*. The anode and the cathode of each LED are electrically connected to the control unit 510, and at least some of the LEDs 521 to 52*n* have different micro diode areas. The control unit 510 and the LEDs 521 to 52*n* may be integrated within a chip or a package, or the control unit 510 may be disposed outside the package without any limitative purpose.

In FIG. 18, the node A and the node B are electrically connected to an AC voltage source (not shown). When the LEDs 521 to 52*n* are driven by the AC voltage source, the control unit 510 changes the serial or parallel connection states of the LEDs 521 to 52*n* according to the voltage of the AC voltage source, and the control unit 510 sequentially turns on the LEDs 521 to 52*n* with different micro diode areas according to the voltage of the AC voltage source. When the voltage of the AC voltage source is lower, the control unit 510 connects most of the LEDs in parallel, and turns on the LEDs with the larger micro diode areas. When the voltage of the AC voltage source is higher, the control unit 510 turns on most of the LEDs and turns on the LEDs with the smaller micro diode areas.

Figure 19:
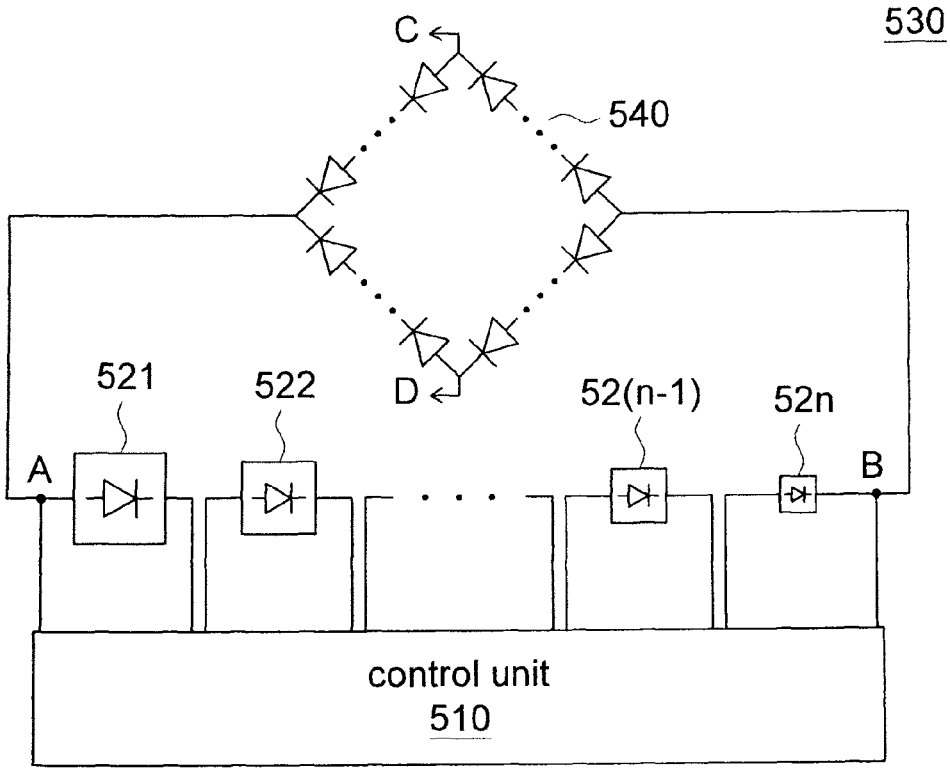
FIG. 19 is a schematic illustration showing an alternating current light emitting device according to a second example of the sixth embodiment of the invention.

FIG. 19 is a schematic illustration showing an alternating current light emitting device 530 according to a second example of the sixth embodiment of the invention. Compared with the alternating current light emitting device 500, the alternating current light emitting device 530 further includes a bridge rectifier 540. The bridge rectifier 540 is electrically connected to the nodes A and B, and the bridge rectifier 540 is electrically connected to the AC voltage source at the nodes C and D and rectifies the AC voltage source so that the LEDs 521 to 52*n* are biased by positive voltage.

Figure 20:
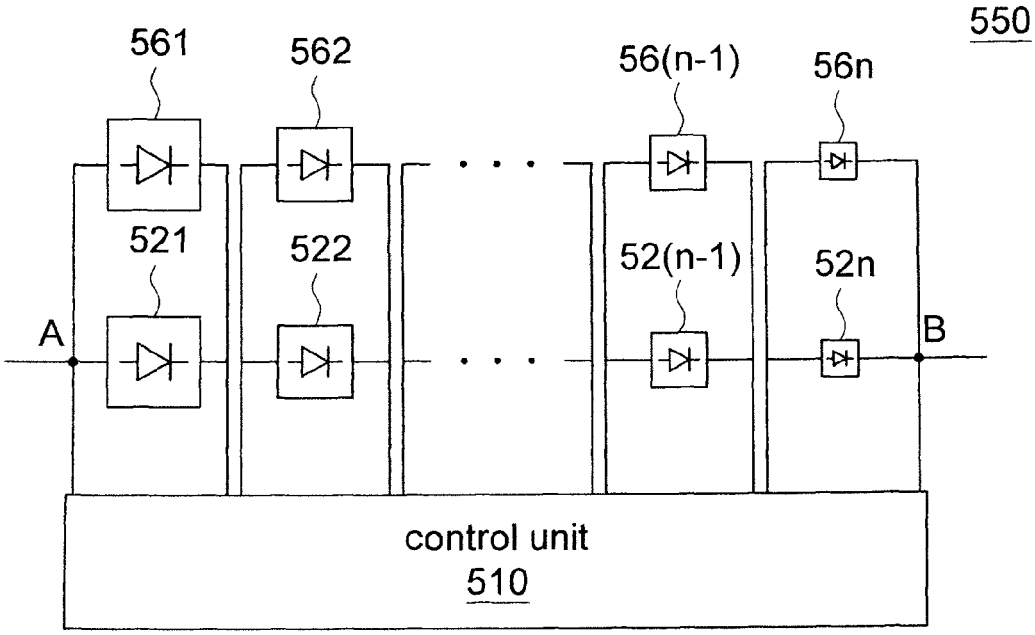
FIG. 20 is a schematic illustration showing an alternating current light emitting device according to a third example of the sixth embodiment of the invention.

FIG. 20 is a schematic illustration showing an alternating current light emitting device 550 according to a third example of the sixth embodiment of the invention. As shown in FIG. 20, each of the LEDs 521 to 52*n* of the alternating current light emitting device 550 is connected in parallel to a corresponding one of the LEDs 561 to 56*n* having the micro diode areas the same as that of the corresponding one of the LEDs 521 to 52*n*. For example, the LED 521 is connected to the LED 561 in parallel, and the LED 52*n* is connected to the LED 56*n* in parallel. In FIG. 20, the LEDs 521 to 52*n* are connected to the same number of LEDs in parallel without any limitative purpose.

Figure 21:
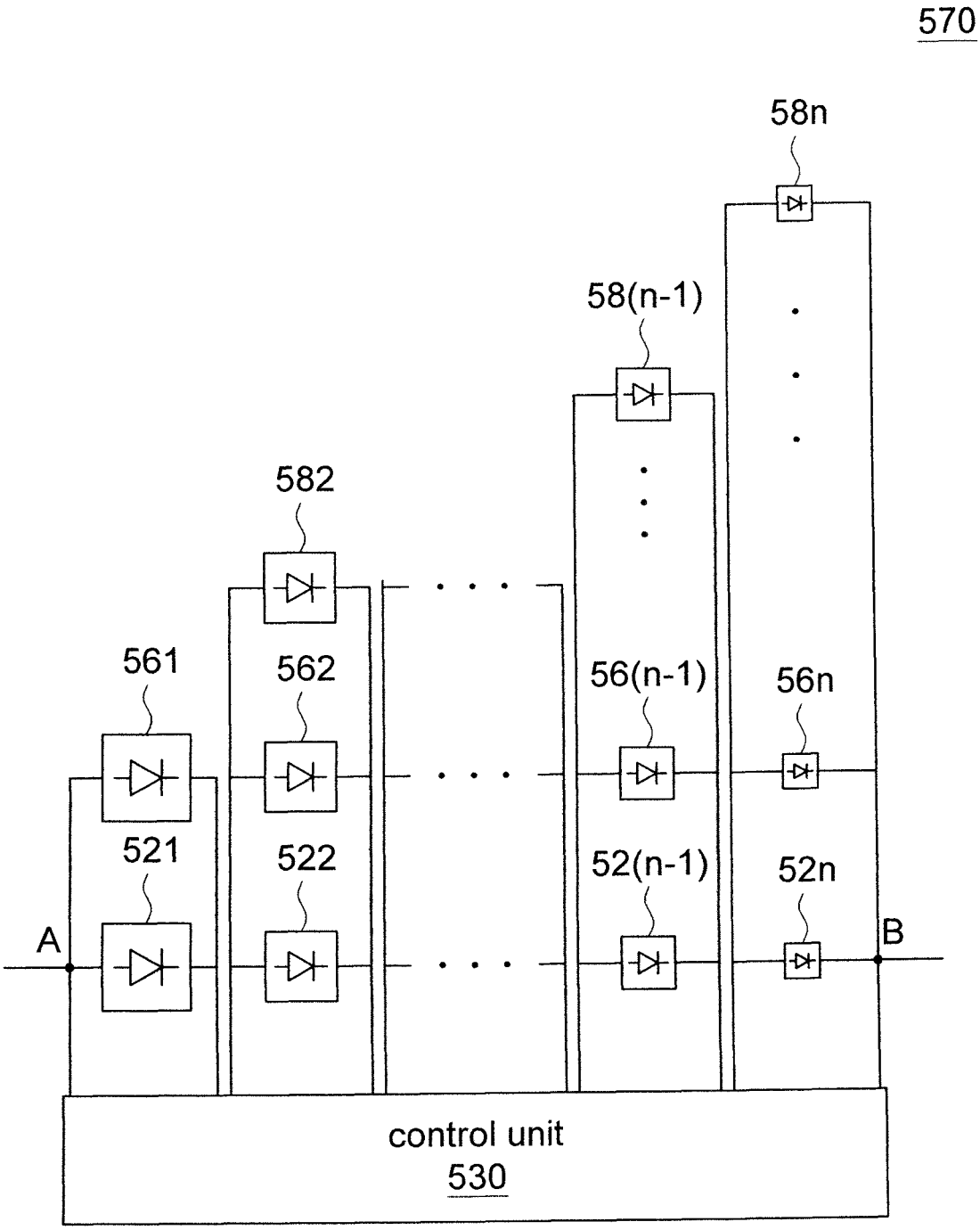
FIG. 21 is a schematic illustration showing an alternating current light emitting device according to a fourth example of the sixth embodiment of the invention.

FIG. 21 is a schematic illustration showing an alternating current light emitting device according to a fourth example of the sixth embodiment of the invention. As shown in FIG. 21, the numbers of LEDs respectively connected in parallel to the LEDs 521 to 52*n* are different from each other, the number of LEDs connected in parallel to the LED with the larger micro diode area is smaller, while the number of LEDs connected in parallel to the LED with the smaller micro diode area is greater. For example, the LED 521 with the larger micro diode area is only connected to the LED 561 in parallel, and the LED 52*n* with the smaller micro diode area is connected to the LEDs 56*n* to 58*n* in parallel. In addition, each LED may also be connected to the LED having the micro diode area different from that of the LED as long as the control unit 510 can sequentially turn on the LEDs with different micro diode areas according to the voltage of the AC voltage source.

The operation principles of the alternating current light emitting devices 500, 530, 550 and 570 according to the sixth embodiment are similar to those of the alternating current light emitting devices 200, 230, 250, 300, 320 and 400 disclosed in the fourth embodiment and the fifth embodiment, so detailed descriptions thereof will be omitted.

In the alternating current light emitting device according to each embodiment of the invention, the waveform of the AC voltage source is modulated so that the total time, for which the currents flow through the LEDs, is lengthened. So, the real power of the alternating current light emitting device is increased and the power factor thereof is increased therewith. Alternatively, the frequency of the AC voltage source is modulated to improve the phenomenon of flicker of the alternating current light emitting device.

In addition, the alternating current light emitting device of the invention also turns on the LEDs with the larger micro diode areas when the voltage is lower and then turns on the LEDs with the smaller micro diode areas when the voltage is higher according to the voltage of the AC voltage source, or changes the serial or parallel connection states of the LEDs according to the voltage of the AC voltage source so that the currents flowing through the LEDs in the alternating current light emitting device become uniform and the alternating current light emitting device is free from the phenomenon of the non-uniform current distribution during the operation. Consequently, the alternating current light emitting device can emit light under the low voltage of the alternating current source, and the light emitting efficiency of the alternating current light emitting device can be enhanced. In addition, the currents, which are becoming uniform, also improve the problem of flicker of lighting.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An alternating current (AC) light emitting device, comprising:

an AC light emitting diode (LED) module comprising at least two sets of micro-diodes; and a waveform modulation unit, coupled between the AC LED module and an AC voltage source, for increasing the full width at half maximum (FWHM) of a waveform of the AC voltage source;

wherein the AC voltage source modulated by the waveform modulation unit turns on one of the two sets of micro-diodes for a first time in a positive half cycle, and turns on the other one of the two sets of micro-diodes for a second time in a negative half cycle.

2. The AC light emitting device according to claim 1, wherein the waveform modulation unit and the AC LED module are integrated within a chip.

3. The AC light emitting device according to claim 1, wherein the waveform modulation unit and the AC LED module are disposed in a package.

4. The AC light emitting device according to claim 1, wherein the micro-diodes are micro-light emitting diodes.

5. The AC light emitting device according to claim 1, wherein the first time is longer than the second time.

6. The AC light emitting device according to claim 1, wherein the first time is shorter than the second time.

7. The AC light emitting device according to claim 1, wherein the waveform modulation unit adjusts the waveform of the AC voltage source into a square wave.

8. The AC light emitting device according to claim 1, wherein the first time or the second time is at least 0.005 second.

* * * * *